US006632042B1

(12) United States Patent
Liener Chin et al.

(10) Patent No.: US 6,632,042 B1
(45) Date of Patent: Oct. 14, 2003

(54) PRINTED SHEET PROTECTOR SYSTEM AND METHOD

(75) Inventors: MaryBeth Liener Chin, Huntington Beach, CA (US); Galen C. Wong, South Pasadena, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/613,639

(22) Filed: Jul. 11, 2000

(51) Int. Cl.[7] ..... B42F 13/00

(52) U.S. Cl. ..... 402/79; 40/359; 40/360; 40/641; 206/232; 229/68.1; 229/71; 283/36; 283/38; 283/42; 402/73; 402/80 R; 402/80 L; D19/26; D19/33

(58) Field of Search ..... 283/116, 36, 37, 283/38, 39, 40, 41, 42, 115; 402/70, 73, 79, 80 R, 80 L, 80 P, 502; 229/68.1, 71, 72, 75; D19/3, 26, 27, 33; 206/232; 281/29; 40/359, 360, 626, 641

(56) References Cited

U.S. PATENT DOCUMENTS

| | | | | | |
|---|---|---|---|---|---|
| 1,492,932 | A | | 5/1924 | Orrell | |
| 3,492,743 | A | | 2/1970 | Schmidt | |
| 3,710,457 | A | | 1/1973 | Rechdahl et al. | 35/48 A |
| 3,807,069 | A | | 4/1974 | Daley | 40/2 R |
| 4,334,771 | A | | 6/1982 | Ryan, Jr. | 355/133 |
| 4,516,871 | A | * | 5/1985 | Leitman | 402/79 |
| 4,573,821 | A | | 3/1986 | Gilreath | 402/78 |
| 4,784,508 | A | * | 11/1988 | Shannon | 402/79 |
| 4,832,373 | A | | 5/1989 | Swan | 283/115 |
| 4,973,086 | A | | 11/1990 | Donnelly et al. | 283/37 |
| 5,011,191 | A | | 4/1991 | Gannon et al. | 283/115 |
| 5,056,825 | A | | 10/1991 | Templet | 283/36 |
| 5,217,259 | A | | 6/1993 | Wilen | 283/116 |
| 5,265,359 | A | * | 11/1993 | Glazer et al. | 40/159 |
| 5,409,753 | A | | 4/1995 | Perez | 428/40 |
| 5,445,417 | A | | 8/1995 | Bromer et al. | 281/46 |
| 5,503,435 | A | | 4/1996 | Kline | 283/67 |
| 5,543,010 | A | * | 8/1996 | Keng | 156/285 |
| 5,639,172 | A | * | 6/1997 | Erickson | 402/79 |
| 5,709,410 | A | | 1/1998 | Reeves, Jr. | 283/67 |
| 5,746,451 | A | | 5/1998 | Weyer | 283/65 |
| 5,788,283 | A | * | 8/1998 | Adler | 281/38 |
| 5,795,089 | A | * | 8/1998 | Ong | 402/79 |
| 5,875,579 | A | * | 3/1999 | Winzen | 40/641 |
| 5,882,038 | A | | 3/1999 | Ong | 281/31 |
| 5,908,259 | A | | 6/1999 | Johnson | 402/79 |
| 5,909,979 | A | * | 6/1999 | Winzen | 402/79 |
| 5,924,812 | A | | 7/1999 | Goldman | 402/79 |
| 6,012,866 | A | * | 1/2000 | Podosek | 402/79 |
| 6,071,030 | A | * | 6/2000 | Hunter et al. | 402/79 |
| 6,106,018 | A | | 8/2000 | McKeown et al. | 283/36 |

* cited by examiner

*Primary Examiner*—Monica Carter
(74) *Attorney, Agent, or Firm*—Oppenheimer Wolff & Donnelly LLP

(57) ABSTRACT

In addition to a set of dividers having staggered tabs and binder holes, the retail packaging includes a sheet protector pocket having a front sheet and a back sheet and binder holes. The user removes the dividers and pocket from the packaging and custom designs and prints sheet indicia on a paper sheet. He/she then inserts the printed sheet into the pocket whereby the front sheet allows the sheet indicia to be viewed therethrough. The front sheet has pre-printed indicia thereon. With the printed sheet in the pocket and the pocket and dividers assembled in a ringed notebook or other binding system, the sheet indicia and the pre-printed indicia line up with respective ones of the tabs. The indicia thereby form an attractive custom-designed table of contents, which can be easily corrected or changed by the user by simply printing and inserting into the pocket a new sheet. The front sheet can either be transparent or have a window to allow the sheet indicia to be viewed therethrough. An alternative provides the pre-printed or custom-printed indicia on a separate transparent sheet which is inserted in the pocket in front of the printed sheet. Another invention is a pocket assembly having front and back sheets and binder holes and compartments for inserting therein one or more photographs, other images or the like, which can be viewed through the transparent front sheet. Pre-printed framing designs on the front sheet attractively encircle the photographs.

108 Claims, 15 Drawing Sheets

PRINTED SHEET PROTECTOR SYSTEM AND METHOD

BACKGROUND OF THE INVENTION

The present invention is directed to systems, apparatuses and methods for protecting, storing, organizing and/or displaying printed sheets, photographs, clippings from periodicals, handwritten pages, drawings and so forth. As an example, the invention is concerned with user-customizable ring binder indexing systems. Further examples are user-customizable sheet protector apparatuses and particularly those which are at least partially transparent so that their sheet contents can be viewed and those which have binder ring holes.

A number of protecting and organizing systems are known in the prior art. One example is shown in FIG. 1 and referring thereto, a prior art system shown generally at 100 is the READY INDEX—CONTEMPORARY TABLE OF CONTENTS—DIVIDERS PRODUCT available from Avery Dennison Corporation of Pasadena, Calif., and illustrated assembled in a three ring binder 104 with the user's document pages 108 filed therein. The system 100 is sold in a package that includes the table of contents page 112 and a set of tabbed dividers 116. The illustrated prior art embodiment includes a five tab set, but the product is also available in an eight tab set, as well as ten, twelve and fifteen, months, A–Z, and 1–31 tab sets. Each of the tabs 120 of the tabbed dividers 116 may have a sequential number 124 pre-printed thereon, and each tab can be colored with a different color (e.g., yellow, orange, red, magenta and purple).

The table of contents page 112 has a series of pre-printed fields, one above the other, and abutting the right edge. Each of the fields is aligned with a separate tab 120, when the table of contents page 112 is aligned or stacked with the dividers 116, such as when filed in a ring binder 104 through the binder holes 124 in the table of contents page 112 and each of the tabbed dividers, as illustrated in FIG. 1. Each of the fields has a central block 128, a right edge strip 132, a connecting horizontal line 136 and a (blank) block 140 between the central block and the strip and above the line. The central block 128 and the strip 132 are printed or formed with the same color (e.g., yellow, orange, etc.) as the color of the corresponding (adjacent, aligned) tab 120. And the same number 142 (e.g., 1, 2, 3, 4 or 5) as the number 124 on the corresponding tab 120 is pre-printed in the central block 128.

The user, after removing the table of contents page 112, dividers and instruction sheet (not shown), from the retail packaging follows the instructions on the instruction sheet to custom design or format the page on his/her personal computer using existing software. For example, he/she can use preset layouts in existing software such as MICROSOFT WORD FOR WINDOWS, COREL WORDPERFECT FOR WINDOWS, COREL WORDPERFECT FOR DOS, LOTUS WORD PRO AND LOTUS AMI PRO, following the instructions in the instruction sheet, such as the QUICK START!, copyright 1998, instruction sheet. (The entire contents of this instruction sheet publication and all other publications and patents and applications mentioned anywhere in this disclosure are hereby incorporated by reference.) The user thereby designs the section titles 144. (The user can also put titles in the table of contents via typewriter, labels and handwriting.)

The user then prints the titles 144 onto the table of contents page 112 using a laser or ink jet printer or copier.

He/she then assembles the document using the custom-printed table of contents page 112, matching pre-printed tabs 120, and document pages into the three ring binder 104 to form system 100. A problem with system 100 is that only a single table of contents page 112 is provided in the package, and thus if the user or the printer makes a mistake in formatting or printing the titles or if the user changes his mind as to the desired titles, another package having another table of contents page must be purchased. In other words and more specifically—the table of contents page 112 can rip, get dirty or wrinkled and thus some consumers find them to not be sufficiently durable; the page has a specific orientation requiring that the user load it in the printer in a specific direction, with printing errors resulting if it is not loaded properly; and since only one page is provided in a package, a printing error essentially ruins the entire packaged set.

Another prior art custom-designed table of contents sheet system (not illustrated in the drawings) is disclosed in U.S. Pat. No. 5,503,435 (Kline). Pursuant to the '435 patented system, first and second tabbed index sheets and a table of contents page are provided. First and second labels are releasably attached to the front of the table of contents page generally adjacent to but spaced from descriptive field areas on the page. The page is passed through a printer or copier, and custom indicia are printed on the labels and in the field areas in the same printing operation. The labels are then removed by the user and attached by their adhesive backings to the respective tabs. The labels before printing are adhered directly to the page inward of the descriptive field areas, to a removable carrier strip, which is adhered to the front of the page or to a tear-away strip at the bottom of the page. This system does not have the flexibility in construction and is a little more labor intensive than some users desire.

Another prior art divider apparatus is illustrated in FIG. 2, generally at 200, and is commercially available as the CLIP AND CREATE VIEW DIVIDERS product from the Avery Dennison Corporation. This apparatus 200 includes a clear plastic pocket 204 having an open top 208, a binder strip 212 with binder holes 216 along its left edge and a tab 218, which extends out from the right edge and has an open top 224. Provided in the retail package in addition to a set of these pocket apparatuses, is a sheet (not shown) having a strip of perforated tab inserts and printed instructions. The titles 228 for the tabs 220 are formatted using templates available in many different software programs. The tab title words, fonts and margins are selected by the user on his/her personal computer using the program. The tab sheet is loaded into the manual feed tray of the user's printer, and the tab inserts 220 are printed. The printed inserts 220 are separated from each other and the surrounding sheet along the perimeter perforations. The separated, printed tab inserts 220 and then folded and inserted into the tab holders through the open tops 224, as show by the arrow 234 in FIG. 2.

The desired sheet material 240, such as printed or handwritten sheets, photographs, clippings, and so forth, are inserted into the pocket 204 through the open top 208 and are visible through the clear front panel 244 of the pocket. The tab title 228 can be a descriptor of the inserted material 240 or can be a sequential indicia (such as numbers, months, etc.). The pocket apparatus 200, together with other pockets, can be inserted into a three ring binder, such as that shown in FIG. 1 at 104. Although this product is useful in, for example, personalizing school subjects and memory books, it does not provide for a table of contents sheet or other means of personalizing, decorating, indexing or labeling the pocket contents (240).

SUMMARY OF THE INVENTION

Directed to remedying the deficiencies in the prior art, the present invention has many forms and embodiments including the overall system, the apparatus component and the method of use. One feature of the present invention is a sheet protector that includes a clear or translucent plastic sleeve or a translucent or opaque plastic or paper envelope with one or more windows through which the contents of the sleeve can be viewed. The sheet protector is printed to enhance it and/or its content's functionality and/or attractiveness. The sheet protector may exist in many forms as discussed below. The sheet protector may be printed with a decorative element on one or both sides with the design element to coordinate with its contents or with other items assembled or bound therewith, such as index dividers.

Another definition of the present invention uses a clear view table of contents sheet or page with a set of dividers. The sheet includes a sleeve made of plastic and/or paper that has coordinating tab colors and/or numbers printed on selected areas of the protector. The consumer uses standard READY INDEX SOFTWARE templates to lay out the tab titles on the page. He/she prints custom-formatted tab titles on a plain piece of paper, for example, and then inserts the printed paper into the sleeve. Thereby, the tab titles can be seen through the clear plastic front sheet of the sleeve. This table of contents sleeve provides durability and protection to the printed table of contents sheet. Another benefit of this embodiment is the consumer can print the titles on plain paper and if an error is made or if a change is desired, it can easily be corrected or changed by printing another sheet of plain paper and inserting it into the sleeve.

A further embodiment is to provide a printed sheet protector that is used as a photo page. The printed portion acts as a frame around each photo, bordering the photograph. The printing alternatively or additionally can be used as decorative elements to enhance the photograph. The sheet protector may have small compartments or windows into which individual photographs are inserted, or it may have a single large section to be used for a collage of photographs or a single large photograph. Additionally, the printed portion may have a special surface on which dates or journals to describe the photographs or contents, using writable inks or the like, can be written by the user. The printed portions can be decorated with themes of popular photographed events, such as holidays, weddings, birthdays, babies, sporting events and so forth. Instead of photographs, other visual sheets can be used, such as drawings, artwork, cover sheets for reports and so forth. As an example, it may be used by a parent to decoratively frame and protect his/her children's early handprints or artwork.

A further embodiment includes the sheet protector sold to the consumer with an inkjet receptive coating that allows the consumer to print his/her own designs directly onto the sheet protector using his/her inkjet printer.

Another embodiment has the sheet protector packaged with a transparent insert that is printed with the functional or decorative elements previously described. The transparent insert is to be placed by the consumer inside the sheet protector followed by a sheet of paper which has been printed with the desired indicia by the consumer. The insert is preferably the same size as the sheet of paper. And the resulting product is a printed or preprinted sheet protector.

Another embodiment includes the sheet protector packaged with a transparent insert that has an inkjet/laser receptive coating. This allows the transparent insert to be designed and printed by the consumer with the design(s) of his/her choice. The consumer then inserts the printed transparent insert into the sheet protector, followed (or preceded) by a sheet printed by the consumer. The results is a custom-printed sheet protector, designed entirely by the consumer.

A further embodiment provides the set of dividers made from clear or transparent plastic having colored, numbered or otherwise indicia-identified tabs. The table of contents design is printed on the body of the first divider. The consumer uses standard READY INDEX software templates (or similar software) to print tab titles on a plain sheet of paper, which is placed in the binder or report cover behind the first divider. The tab titles are viewable through the clear or transparent body of the first divider surrounded by the appropriate design which is preprinted on the divider body. The page can be attached to the divider if desired, such as by a self-adhesive strip.

A still further embodiment of the present invention includes a lamination pouch that is preprinted with a decorative or functional design into which a consumer places a printed sheet, or photos and laminates by means of thermal lamination or pressure-sensitive adhesive. Again, the printing on the pouch can alternatively be done by the consumer with the pouch being provided with a suitable inkjet or a blank receptive coating.

A yet still further embodiment uses a single sheet lamination overlay printed with decorative or functional designs beneath which the consumer places a printed sheet or photos and laminates by thermal lamination or pressure sensitive adhesive.

Another embodiment includes a protector pocket having a tab divider extending out therefrom. The user prepares a sheet with indicia thereon and inserts the sheet in the pocket into a viewing position. The front sheet of the pocket preferably has pre-printed indicia thereon and aligned with the sheet indicia which is viewable through the front sheet with the sheet in the viewing position. At least one of the indicia of the sheet indicia is aligned with at least one of the indicia of the front sheet and with the tab. The other indicia of the sheet and front sheet are aligned with respective tabs of similar tabbed protector pockets when stacked on top of each other. The insert sheets for each tab section can be immediately behind the corresponding tabbed protector pocket, or less desirably inside the pocket and behind the sheet.

Alternatively, one or more decorative elements can be printed on the body of the divider, such as Avery Dennison Corporation's TABBED SHEET PROTECTOR product (such as shown in FIG. 2). The decorative element can be popular licensed artwork, such as the popular POKEMON characters or the SWOOSH logo of the Nike Corporation, or it can be descriptive of the intended contents of the pocket, such as "Geometry Assignments." A variation is to use a one-ply polypropylene divider; an example is the Avery TABBED SHEET PROTECTOR product that is not a pocket, but rather has only one polypropylene layer forming the body and the tab is still an insertable tab. This divider, pursuant to the invention variation, would be printed with one or more decorative or descriptive elements as described above.

The invention allows consumers to print information or designs directly onto the sheet protectors, thereby avoiding tampering with the contents of the sheet protection. This allows consumers to add temporary markings to a document without printing directly on them. Pursuant to another feature herein the consumer can customize the printing on the insert.

A further description of the invention is a system that allows consumers to print the table of contents page on a plain sheet of paper and view the tab titles through a transparent or translucent body of the divider which being formed of plastic and disposed in front of it, protects it. The paper sheet may be loose or attached to the divider by means of a self adhesive strip on the back side of the divider, or notches in the divider which hold the sheet, or clips on the back side of the divider. When the printed page is adhered to the divider page, the first page of the document will preferably not be the table of contents page.

In other words, disclosed herein is a sheet protector, which includes a clear or translucent plastic sleeve or a paper or translucent or opaque plastic envelope with windows through when the sleeve contents can be viewed. The sheet protector is printed to enhance the functionality and/or attractiveness of its contents or the sheet protector itself. The following are examples of some of the forms of the sheet protector:

(1) A sheet protector that is printed with a decorative element on one or both sides with a design element to coordinate with other document handling items, such as three ring binders, report covers and dividers.

(2) A clear view table of contents sheet used with a set of dividers; it is a sleeve made of plastic and/or paper, for example, which has the coordinating tab colors printed on selected areas of the sheet protector. The consumer uses commercially available READY INDEX software templates to lay out the tab titles on the page. He/she prints a plain piece of paper with the tab titles and inserts the printed plain paper into the sleeve whereby the tab titles can be seen through the clear plastic. This table of contents sleeve provides durability and protection to the printed title sheet. Another consumer benefit is the ability to print the titles on a plain sheet of paper; thus, if there is an error, it can be easily rectified by printing another sheet of plain paper and inserting it into the sleeve.

(3) A printed sheet protector used as a photo page with the printed portion acting as a frame around each photo, bordering the photograph. Instead of defining a frame, the printing can be used as decorative elements to enhance the photographs. The sheet protector can have small compartments to slide individual photographs or larger sections for a collage of or a large photograph. The printed portion may also include a space having a surface on which the user can write with writeable inks dates or journaling to describe the photograph or contents. The printed portions can be decorated with themes of commonly photographed events, such as holidays, weddings, birthdays, sporting events and babies.

(4) The sheet protector is printed with an ink jet receptive coating that allows the consumer to print his own designs directly onto the sheet protector using his/her ink jet printer.

(5) A sheet protector is provided (packaged) with a transparent insert that is printed with the above-described functional and/or decorative elements. The insert is to be placed inside the sheet protector followed by (or with) a sheet of paper which is printed by the consumer. The insert is preferably the same size as the printed sheet of paper. A pre-printed sheet protector is thereby formed.

(6) A sheet protector is packaged with a transparent insert that has an ink jet/laser receptive coating. The insert is designed to be custom formatted and printed by the consumer, and inserted into the sheet protector before, after or with a consumer printed sheet to form a custom designed and printed sheet protector.

(7) A set of dividers is made from clear or translucent plastic having colored, numbered tabs. The table of contents design is printed on the body of the first divider. The consumer uses the READY INDEX software templates, for example, to print tab titles on a plain sheet of paper which is placed in the binder or report cover behind the first divider. The tab titles are seen through the clear or translucent body of the first divider surrounded by the appropriate design which is preprinted on the divider body. The page is preferably attached to the divider, such as with a self-adhesive strip.

(8) A consumer positions a printed sheet or a photograph into a lamination pouch that is preprinted with one or more decorative or functional designs and laminates the assembly using thermal lamination or pressure sensitive adhesive.

(9) A single sheet lamination overlay is printed or preprinted with decorative and/or functional designs and a consumer places a printed sheet or photos underneath the overlay and laminates them together using thermal lamination or pressure sensitive adhesive.

The film or material used for the pockets or protectors can be polypropylene with thicknesses of between 0.0002–0.00050 inch; for example, 0.0002 inch for economy weight, 0.00024 for standard weight, 0.00033 for heavyweight, and 0.00050 for superheavyweight. Aside from polypropylene, polyester, polyethylene and vinyl can be used Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
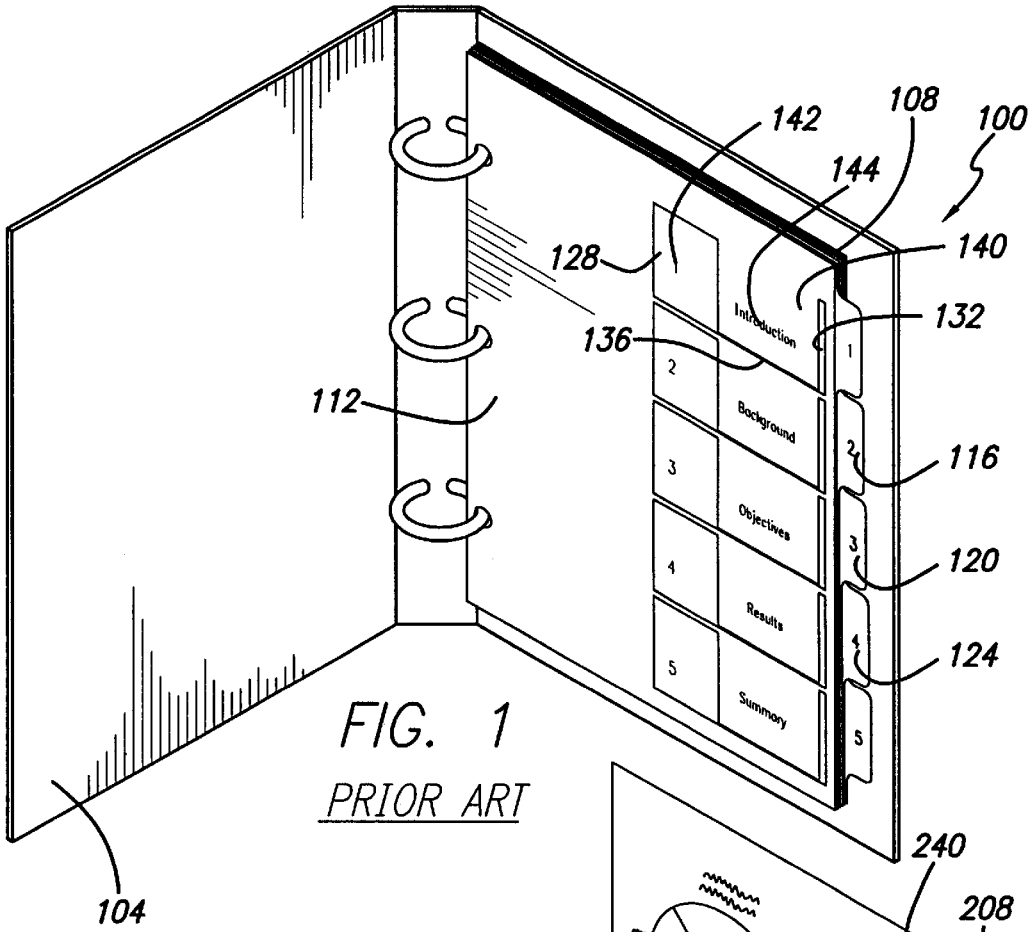
FIG. 1 PRIOR ART
FIG. 1 is a perspective view of a printed table of contents sheet (or page) and divider system of the prior art.
Figure 3:
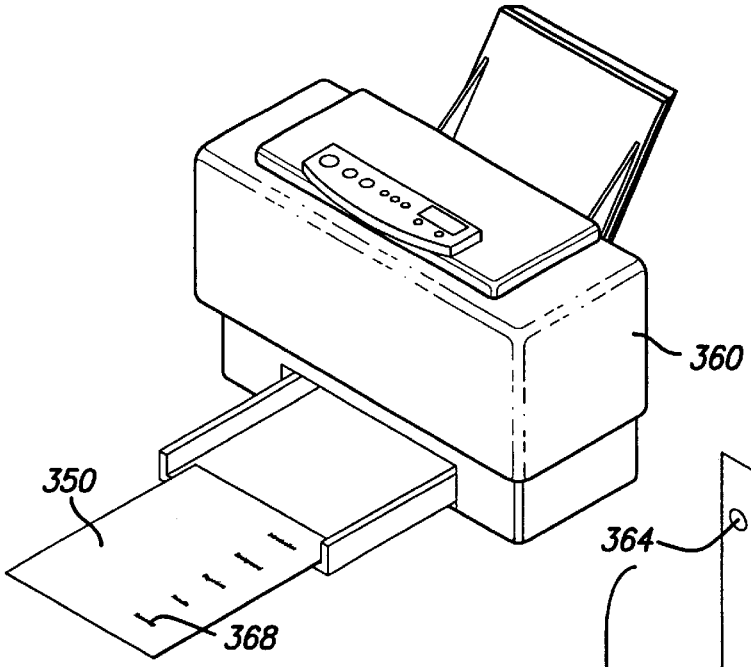
FIG. 3 is a perspective view illustrating a printer printing a (custom designed) table of contents sheet of the present invention.
Figure 4:
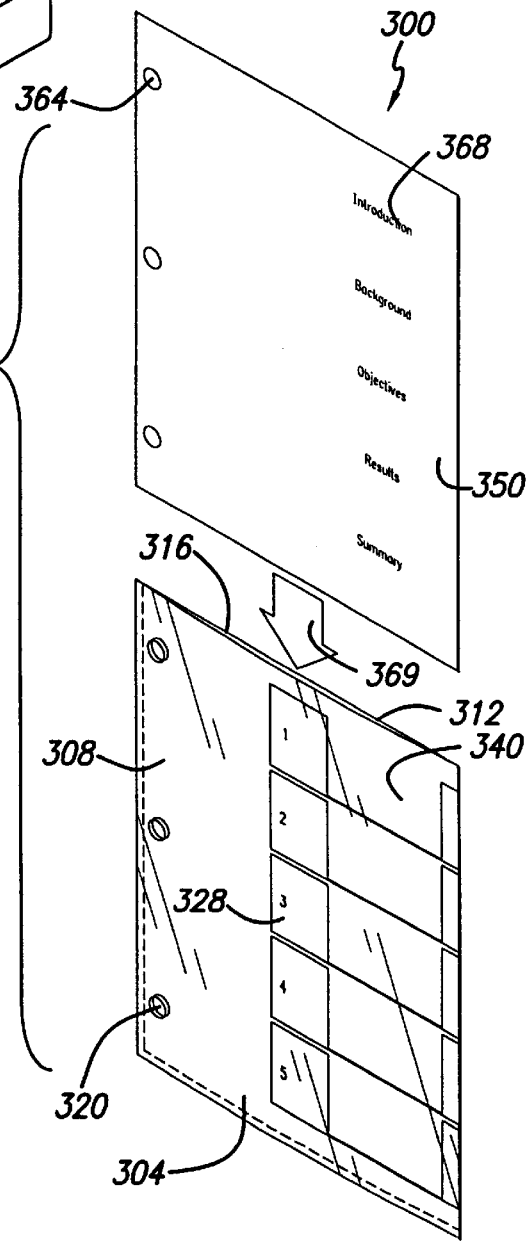
FIG. 4 is a perspective view illustrating the printed sheet of FIG. 3 being inserted into a pre-printed transparent sheet protector pocket to form an apparatus of the present invention.
Figure 5:
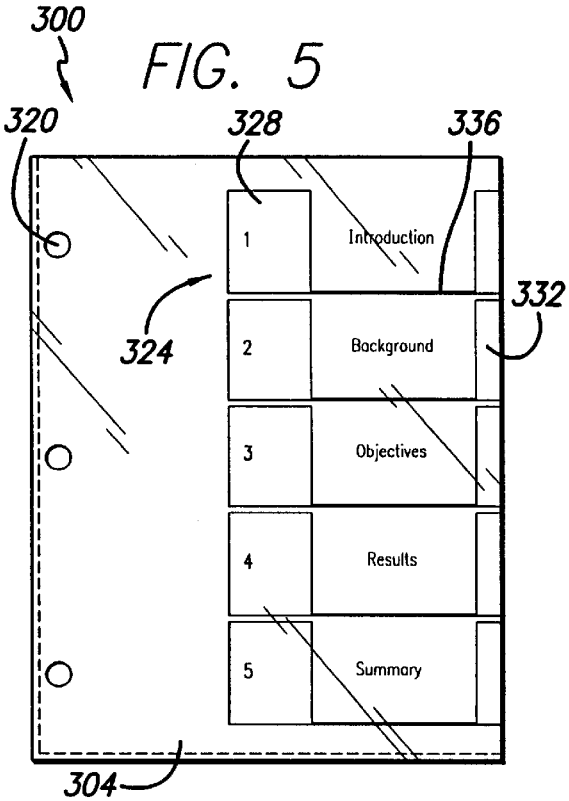
FIG. 5 is a front elevational view of the assembled apparatus of FIG. 4 (which can be used for example with index dividers assembled in a three ring binder similar to the system of FIG. 1)

A first apparatus embodiment of the present invention is illustrated in FIGS. 3–5 generally at 300. Referring thereto, a pocket protector 304 is provided, and construction and printing processes therefor will be described later. Basically, it includes transparent front and back sheets 308, 312 joined to form a pocket having an opening 316, preferably at the top. Ring binder holes 320 are formed along the left edge. And pre-printed on the front sheet are fields 324, similar to those printed on the prior art table of contents page 112 in FIG. 1. As an example, each field includes a central block 328, a right edge strip 332, a connecting horizontal line 336 and a blank block 340 between the central block and the strip and above the line. Each (horizontally) oriented field is aligned with a respective tab of a divider of a set of dividers, such as those shown in FIG. 1, when in a binding system such as the ringed notebook of FIG. 1.

The titles to form this table of contents are (preferably) not printed on the front sheet (with the pre-printed fields). Rather, after the user has selected and formatted them on his personal computer using existing software, he/she prints them out on a sheet of paper 350 using a printer or copier 360, such as is illustrated in FIG. 3. The sheet of paper 350 can be a plain sheet of paper (as illustrated in the drawings) or can have pre-printed material. It can have pre-punched binder holes or the user can punch the binder holes 364 before or after the printing operation. Alternatively, no binder holes can be used where a binder strip is used such as in FIG. 20 or where a ring binder notebook is not to be used. Instead of a ring binder notebook other binding systems can be used such as tape binding, thermal binding, comb binding, velo binding or staple binding. And these alternative binding systems can be used with generally any of the apparatuses and systems described hereafter.

The titles 368 which are printed on the sheet 350 are spaced and sized such that when the sheet is inserted into the pocket down through the open top 316 as shown by the arrow 369 in FIG. 4 into an inserted viewing position, as illustrated in FIG. 5, the titles 368 will be positioned in the respective blank blocks 340. This will give an appearance for the table of contents similar to the prior art table of contents page of FIG. 1.

There are a number of important differences, however. First, the titles 368 are printed on a plain sheet of paper 350, preferably. Thus, if printing or formatting mistakes are made or if the titles need to be changed, the corrective process is simple and inexpensive—the new or corrected titles are simply printed on another sheet of paper, which is inserted into the pocket. Second, the pocket is sturdy, less likely to tear than the prior art paper table of contents page. Third, it protects the titles so that they are less likely to get smudged or stained, and the pre-printed fields on the transparent sheet are also sturdy.

Figure 6:
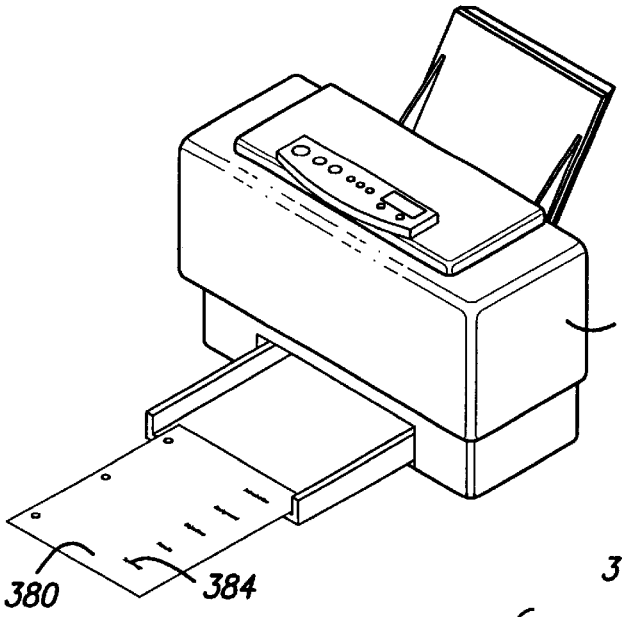
FIG. 6 is a view similar to FIG. 3.
Figure 7:
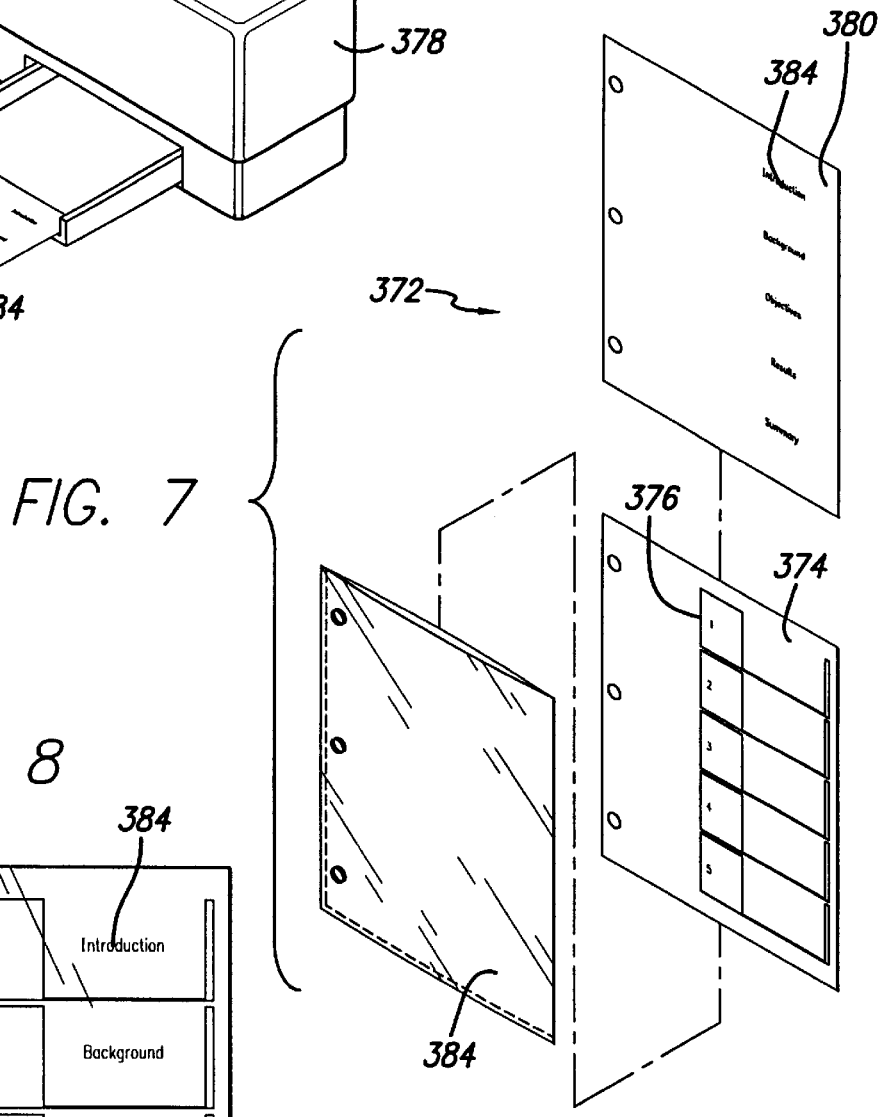
FIG. 7 is a perspective view showing the printed sheet of FIG. 6 (or 3) being inserted together with a pre-printed transparent sheet of the invention into a transparent (unprinted) sheet protector pocket to form an assembly of the present invention.
Figure 8:
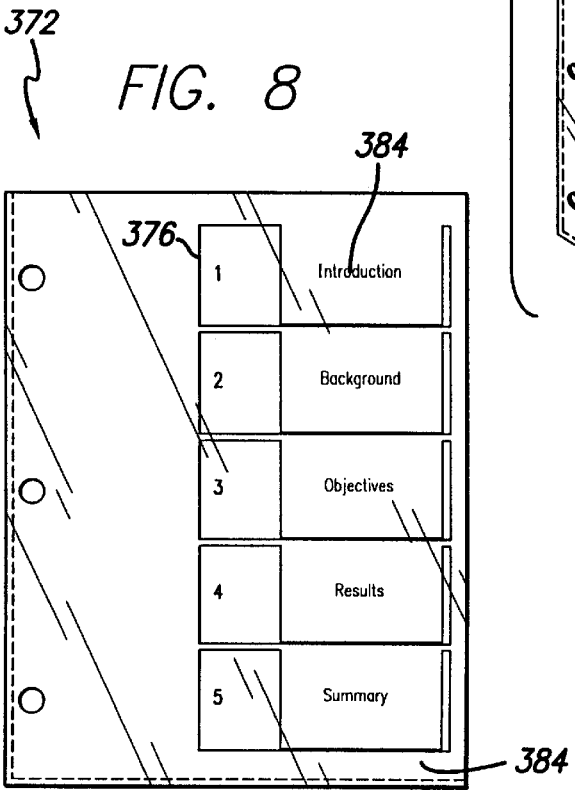
FIG. 8 is a front elevational view of the assembled apparatus of FIG. 7 (which can be used similar to the embodiment of FIG. 5)

A variation of the apparatus of FIGS. 4 and 5 is illustrated by the apparatus 372 in FIGS. 7 and 8. Instead of the front sheet of the pocket apparatus having the field areas pre-printed thereon, a separate transparent sheet 374 with the field areas 376 pre-printed thereon is provided. And then the custom formatted and printed (in the printer or copier 378 of FIG. 6, for example) title sheet 380 with titles, 384 is inserted with the pre-printed transparent sheet 370 into the pocket 384 to form the table of contents apparatus, whose assembled front view is illustrated in FIG. 8. An advantage of this apparatus is that a variety of styles of the pre-printed field area sheets can be provided in a single retail package, providing the consumer a choice, but without the extra expense of one or more additional pockets.

Figure 9:
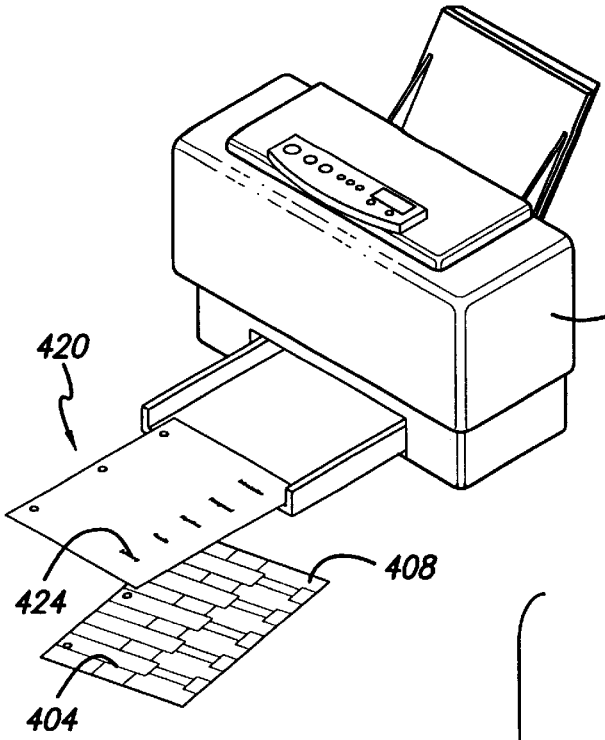
FIG. 9 is a perspective view illustrating a printer custom-printing both a (paper) sheet and a transparent (plastic) sheet of the present invention.
Figure 10:
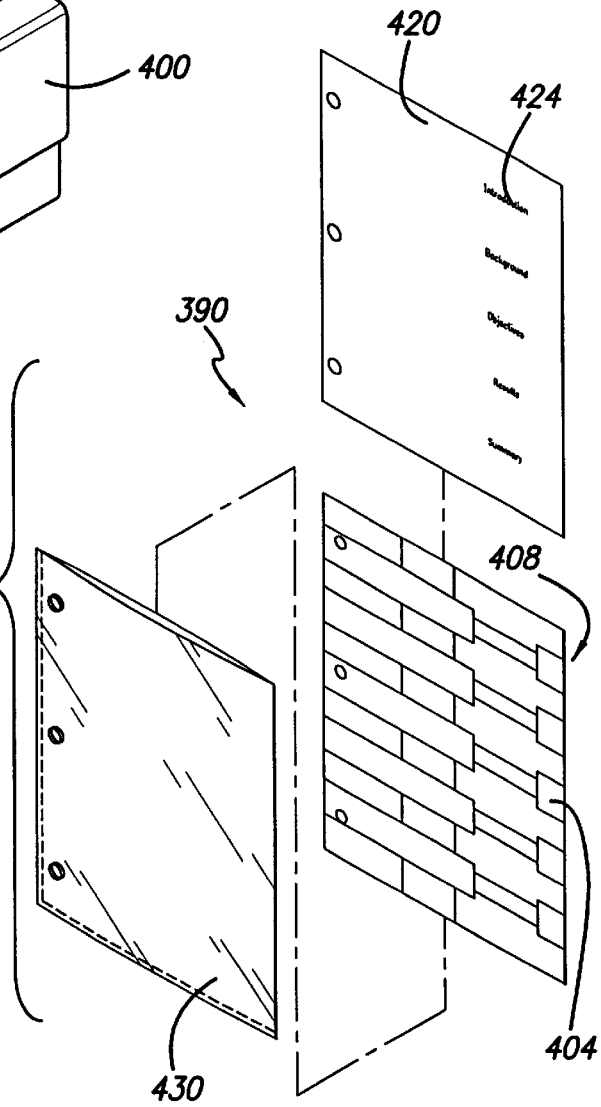
FIG. 10 is a perspective view showing the printed sheet and the printed transparent sheet of FIG. 9 being inserted into a transparent sheet protector pocket to form another assembly of the present invention.
Figure 11:
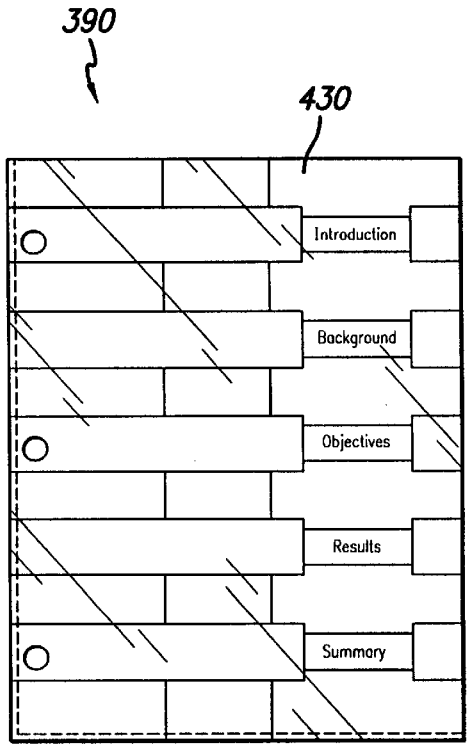
FIG. 11 is a front elevational view of the assembled apparatus of FIG. 10.

A variation of the apparatus of FIGS. 7 and 8 is illustrated in FIGS. 9–11 at 390. Referring thereto, the separate transparent field area sheet is not pre-printed. Rather, the user formats and prints, using the printer or copier 400 of FIG. 9, for example, the field areas 404 on a transparent sheet 408. The transparent sheet 408 can be provided in the product's retail packaging or separately. While a preferred embodiment is to have the sheet provided plain, it alternatively can be partially pre-printed. The FIG. 10 embodiment allows the user to custom format the field areas 408 and to format and print a substitute field area sheet should the need or desire arise. The title sheet 420 printed with titles 424 in printer 400 is positioned behind sheet 408 in transparent pocket 430 as shown in FIG. 11. A less desirable alternative is to print the title page on a transparent sheet and position it in the pocket in front of the field area sheet.

Figure 12:
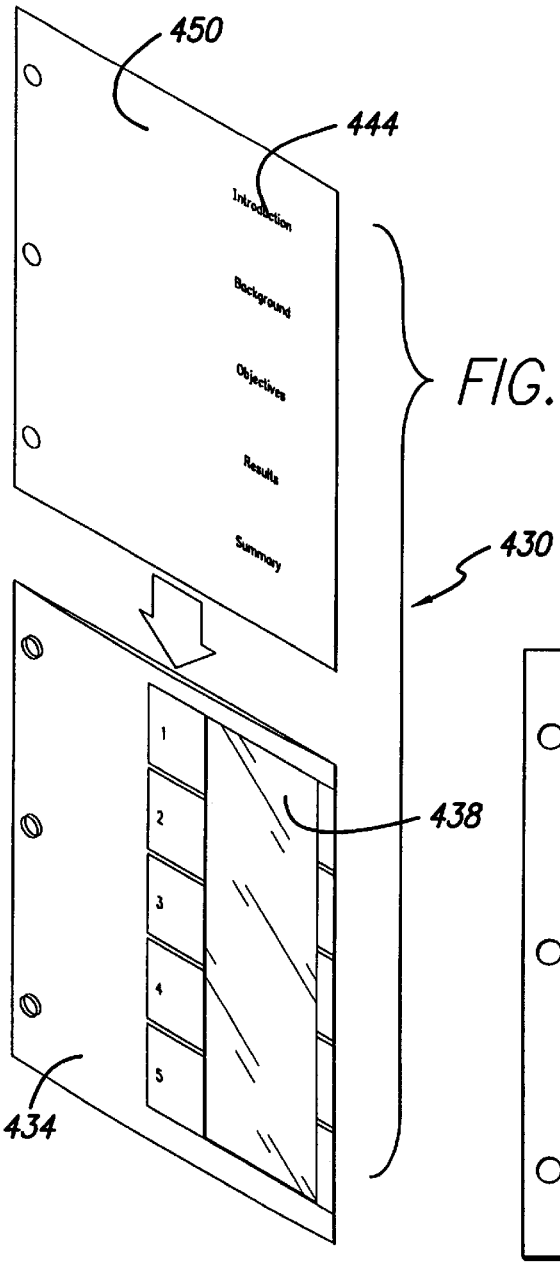
FIG. 12 is a perspective view showing a printed sheet of FIG. 3, for example, being inserted into a pre-printed, windowed sheet protector pocket of the present invention.
Figure 13:
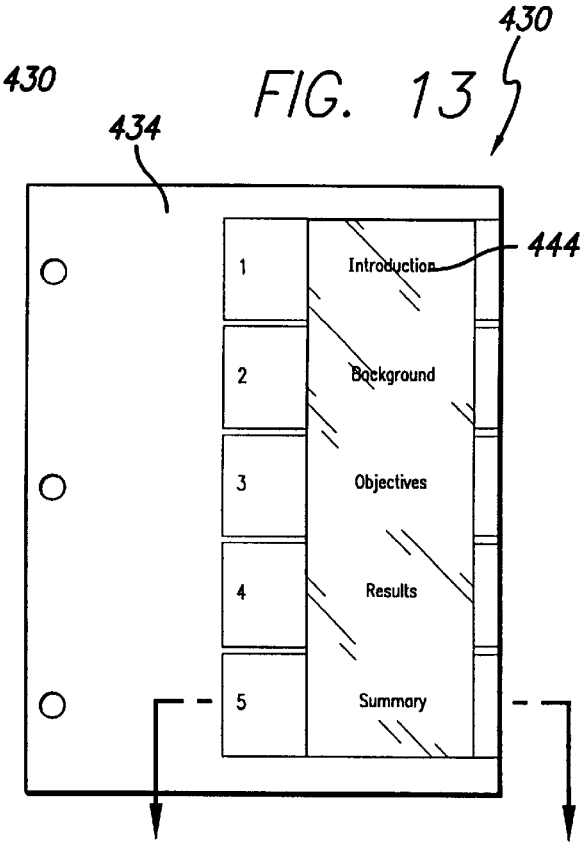
FIG. 13 is a front elevational view of the assembled apparatus of FIG. 12.
Figure 14:
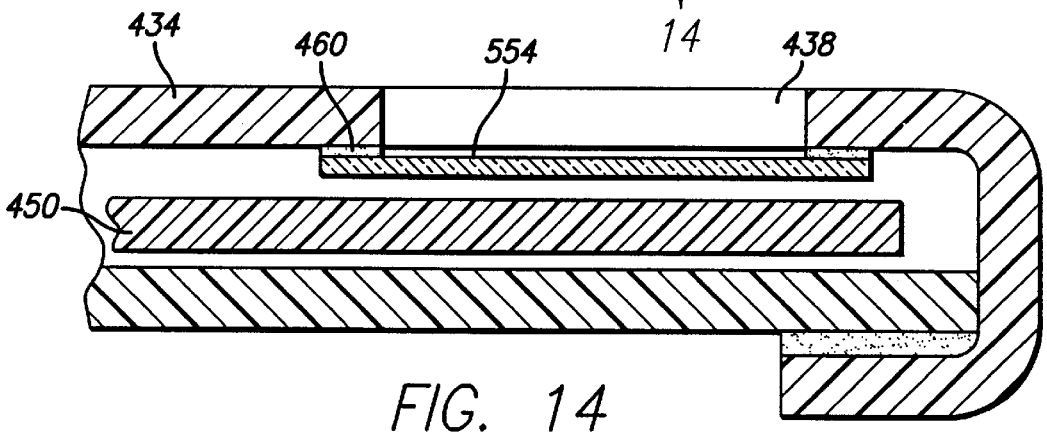
FIG. 14 is an enlarged cross-sectional view taken on line 14—14 of FIG. 13.

The back sheet of the above-discussed pocket apparatuses of the invention can be formed of a transparent plastic. Alternatively, they can be formed with the back sheet being opaque or translucent or some combination thereof. A front sheet of yet another pocket apparatus embodiment 430 does not have a transparent front sheet. Rather, the front sheet 434 is opaque (or translucent) and has a window 438 through which the titles 444 of the title sheet 450, when in the inserted viewing position, can be viewed, as can be understood from FIGS. 12–14. The window 438 can be open (an empty cut-out) or can have a transparent "pane" 454 such as a flexible plastic sheet glued (with glue 460) to an interior surface as best understood from FIG. 14. The embodiment of FIGS. 12 and 13 has the field areas 460 printed (formed or otherwise positioned) on the front sheet adjacent the window 438. Alternatively, the apparatus can be a variation of the apparatuses of FIGS. 7 and 8 or 10 and 11 with the separate field area sheet. And the field area sheet with the title sheet behind it can be positioned in the pocket and viewed through a front sheet window, which would likely be larger than that shown in FIGS. 12 and 13.

There are a number of ways of forming the sheet protectors, as discussed below.

(1) The plastic film is printed in roll form and sent to a machine which produces the sheet protectors. The pre-printing may include an "eye spot" which is detected by the sheet protector manufacturing equipment and results in a feedback system that allows the equipment to register the print so that it is positioned correctly on the sheet protector. The eye spot is cut away as scrap or is printed in a non-visible ink.

(2) The plastic film is printed in roll form and sent to the sheet protector producing machine. The pre-printing does not contain an eyespot, but is toleranced such that the printing is positioned accurately on the sheet protector by virtue of the setup of the sheet protector manufacturing equipment.

(3) The sheet protectors are manufactured using unprinted film. The blank sheet protectors are then sent to another operation where the sheet protectors themselves are printed.

(4) The sheet protectors are manufactured using unprinted film. Print stations are added to the sheet protector manufacturing equipment such that the printing can be performed during the same operation as the sheet protector converting.

(5) Unprinted film is printed in roll form and cut into sheets. These sheets are then folded and/or welded to make the sheet protectors.

Figure 15:
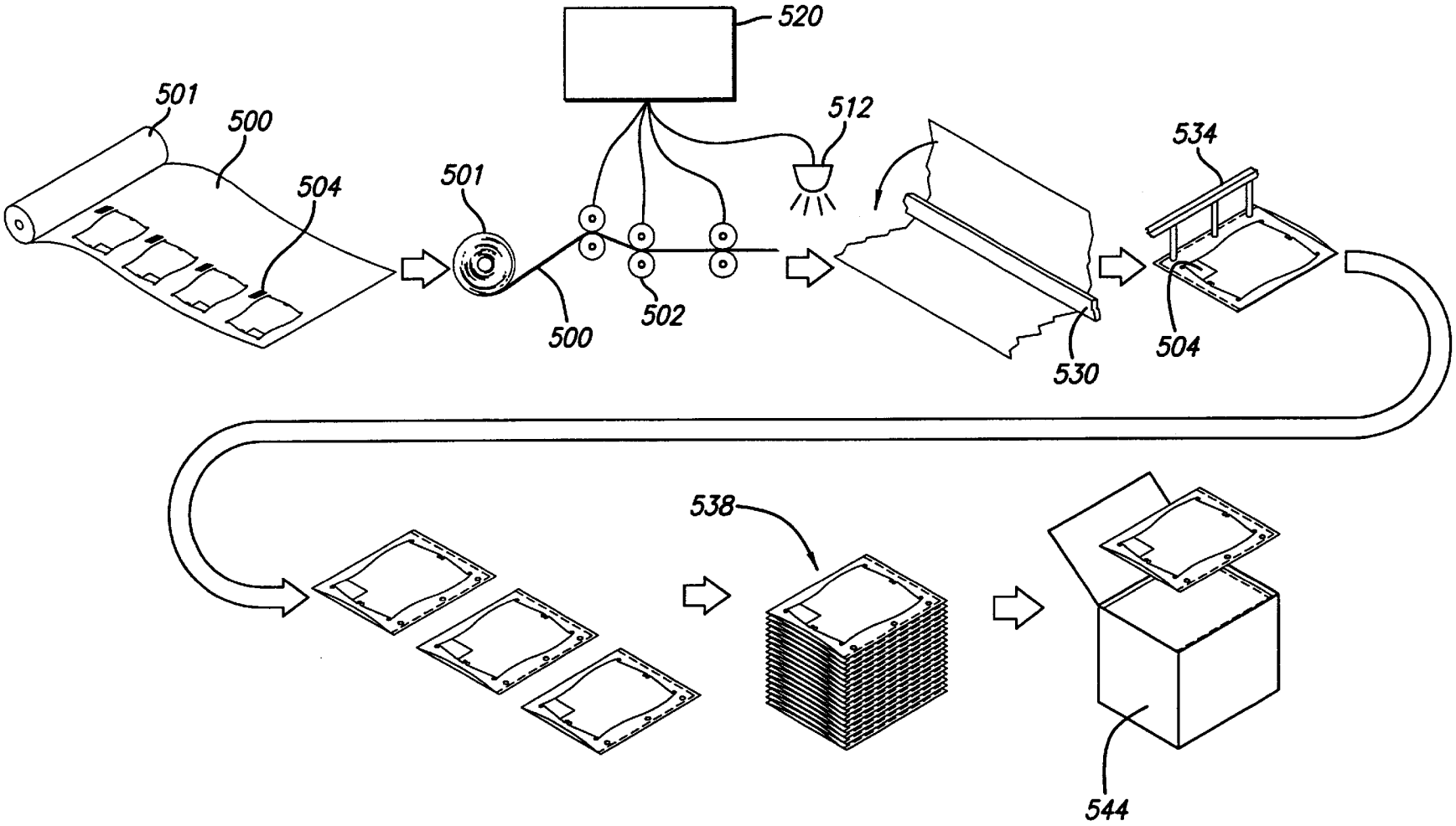
FIG. 15 is a schematic view showing the steps of a manufacturing process of the present invention.

FIG. 15 shows in schematic form the steps of a first manufacturing process of a pocket apparatus of the present invention. A double-wide printed web 500 is provided on a roll 501 and fed through rollers 502, and the eye-marks 504 are sensed at the end of each printed pattern. A sensor 512 senses the eye-marks 504 (e.g., black printed squares) to denote the pattern repeating itself. The sensor feeds back into the roller equipment control 502 to instruct the rollers 502 to go faster or slower so that it gets folded or welded at the correct locations. The sheets are folded 530, welded, hole-punched 534, stacked 538, and boxed or packaged 544.

Figure 16:
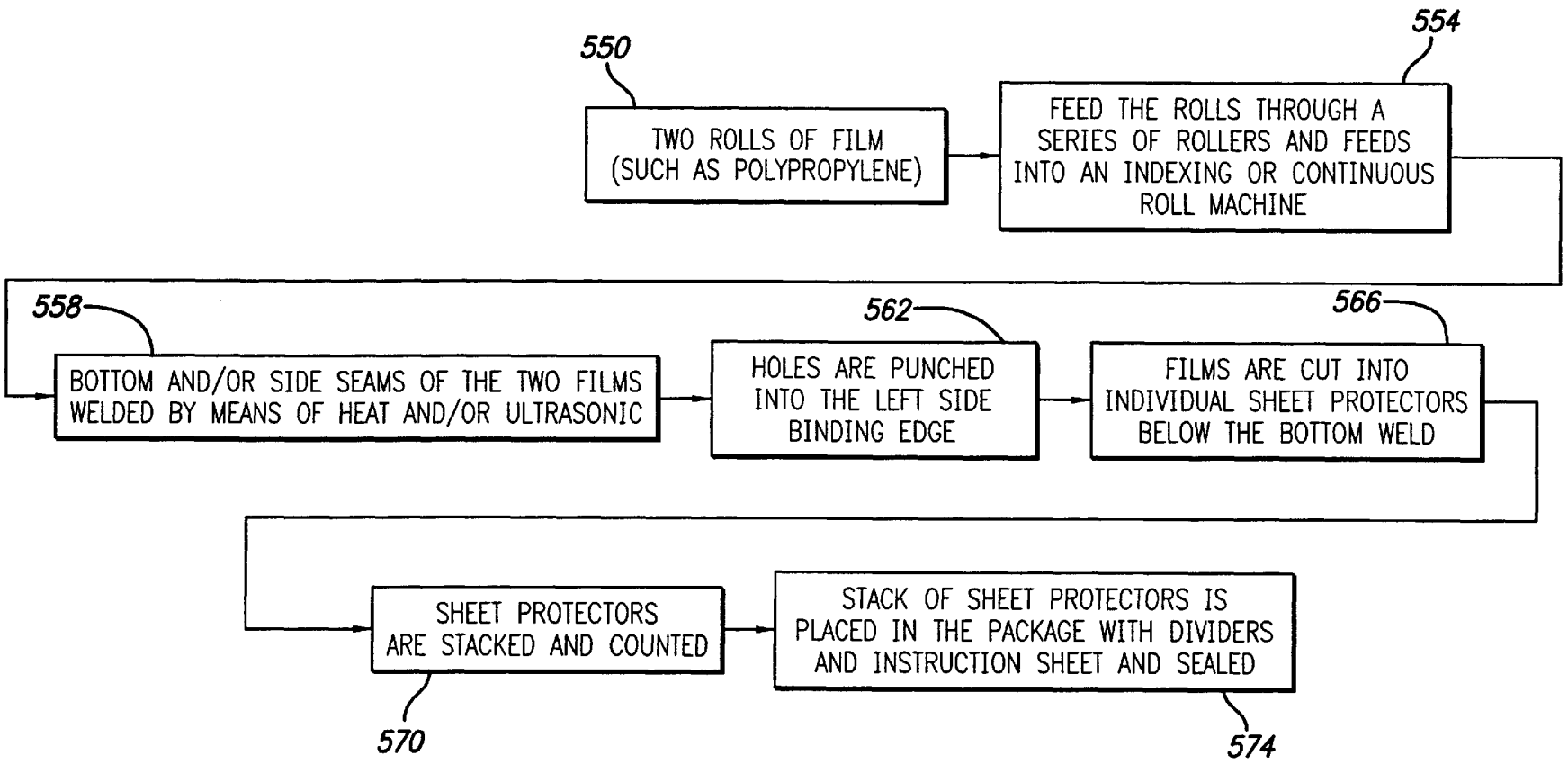
FIG. 16 is a flow chart showing the steps of an alternative manufacturing process of the present invention.

The steps of a second manufacturing process of a pocket apparatus of the present invention are shown in block form in FIG. 16. Referring thereto, briefly, two rolls of film (block 550) are fed into a roll machine (block 554) and the seams are welded together (block 558). Holes are punched in the binding edge as shown by block 562. The films are cut (block 566) below the bottom weld into individual sheet protectors. The sheet protectors are stacked and counted as shown by block 570 and sealed in the package as stated in block 574.

Figure 17:
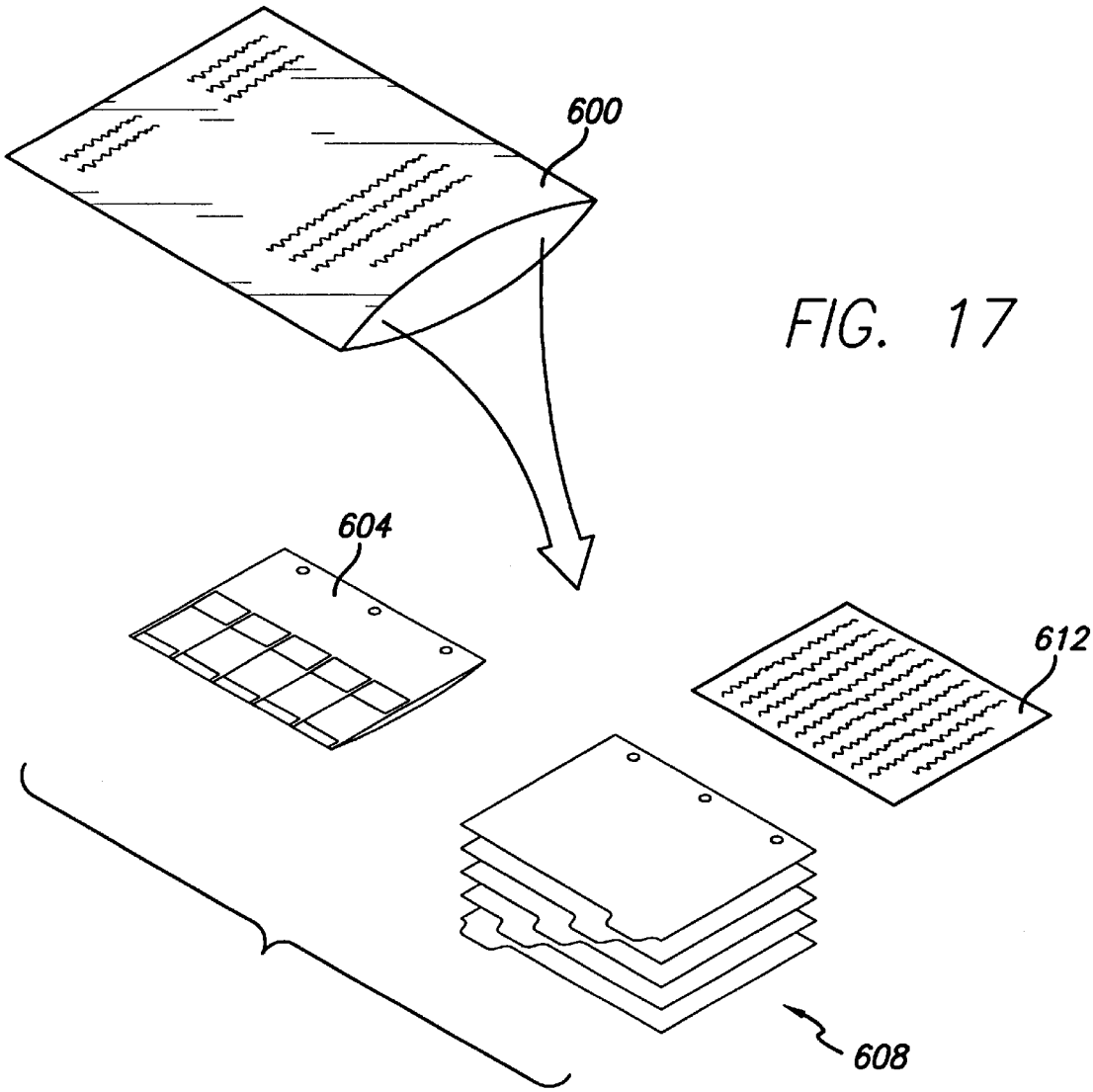
FIG. 17 is an exploded perspective view of a retail packaged divider system of the present invention including the pre-printed sheet protector pocket of FIG. 4, for example.

FIG. 17 shows in perspective how the present invention such as any of the previously-disclosed pocket apparatuses can be supplied to the retail consumer. The product would be sold in a plastic package 600, which contains the pocket apparatus 604, a set of dividers 608, and an instruction sheet 612. The instructions on the instruction sheet alternatively can be printed directly on the plastic package. For the embodiment of FIG. 7, for example, the plastic package (of FIG. 17) can also include the pre-printed transparent sheet.

Figure 18:
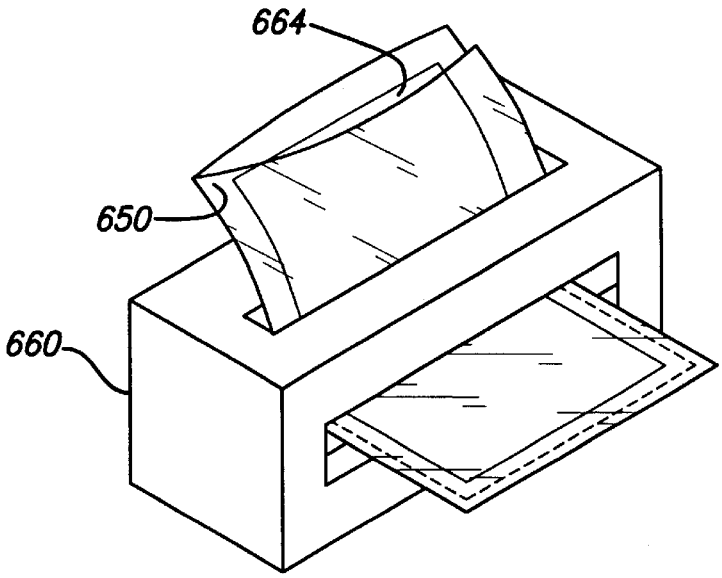
FIG. 18 is a perspective view showing a laminated pocket of the present invention being formed.

The previously-described pocket apparatuses have an open top (or alternatively side) in through which the title sheet is inserted (and out through which it can be removed). The top can remain open, because with the sheet in the pocket apparatus and the pocket apparatus in a ring binder, the rings pass through the binder holes in the pocket apparatus and the aligned binder holes of the contained title sheet, the title sheet is held in the pocket apparatus. Other binding systems will hold the title sheet in the pocket apparatus, too. A flap (see FIG. 25A) can be used to close the open top (or side or bottom), if desired. Alternatively, the pocket apparatus (or folded plastic sheet 650) can be laminated closed with lamination equipment 660, as shown in FIG. 18, about the entire perimeter with the title sheet or other sheet, photograph, newspaper clipping, etc. 664 positioned therein. The pocket apparatus will preferably have some informational and/or decorative pre-printed indicia or designs on the front thereof.

Figure 19:
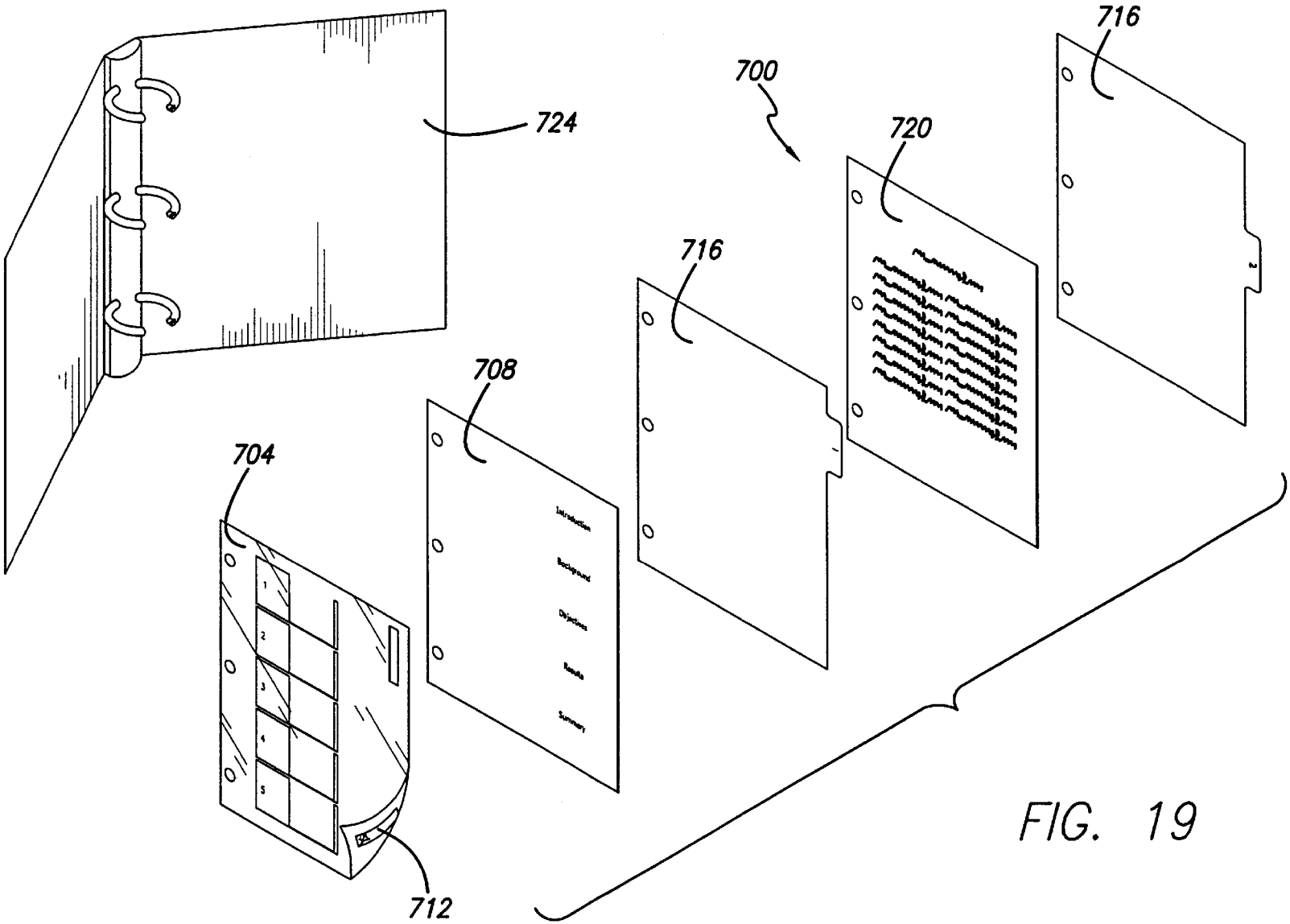
FIG. 19 is a perspective, exploded view of an alternative divider system of the present invention wherein a printed transparency overlay is adhered to a printed sheet to form a two-ply, user-printed table of contents sheet, which is assembled with tabbed dividers and sheet inserts into a ringed binder (or other binding system)

In lieu of a pocket apparatus, an alternative system 700 of the present invention is illustrated in FIG. 19. Referring thereto, a transparent, single layer pre-printed table of contents sheet 704 is provided and the custom formatted and printed title sheet 708 is adhered to the back of the table of contents sheet with adhesive strips 712 or the like. The two-ply sheet can then be assembled with tabbed dividers 716 and document sheets 720 into a ringed binder 724, or into another binder system. Instead of being pre-printed the table of contents sheet can be custom formatted and printed by the user.

Figure 20:
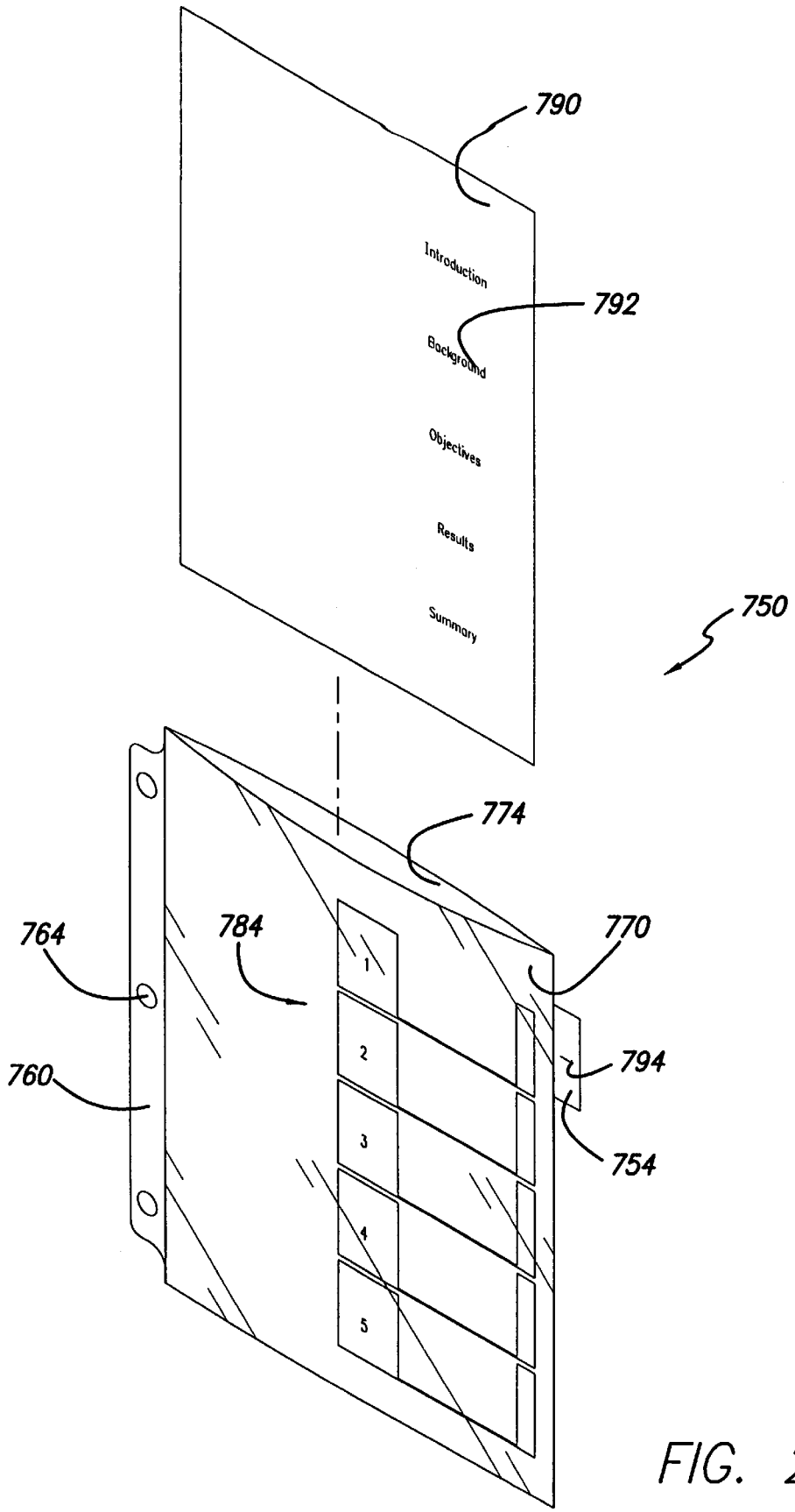
FIG. 20 is a perspective view illustrating a printed sheet, such as that of FIG. 3, being inserted into a pre-printed tabbed transparent sheet protector pocket to form an assembly of the present invention.

A further alternative pocket embodiment is shown in FIG. 20 at 750. One difference between it and the embodiment of FIG. 4 is that a divider tab 754 extends out from an edge of the pocket apparatus and is preferably integrally formed therewith. Although it is depicted as having a binder strip 760 (with binder holes 764) extending out from an opposite edge of the pocket apparatus, the binder holes can be formed to pass through the front and back sheets 770, 774 of the pocket apparatus, similar to embodiments illustrated in earlier drawing figures. Alternatively, those embodiments can be provided with the binder strip.

Figure 2:
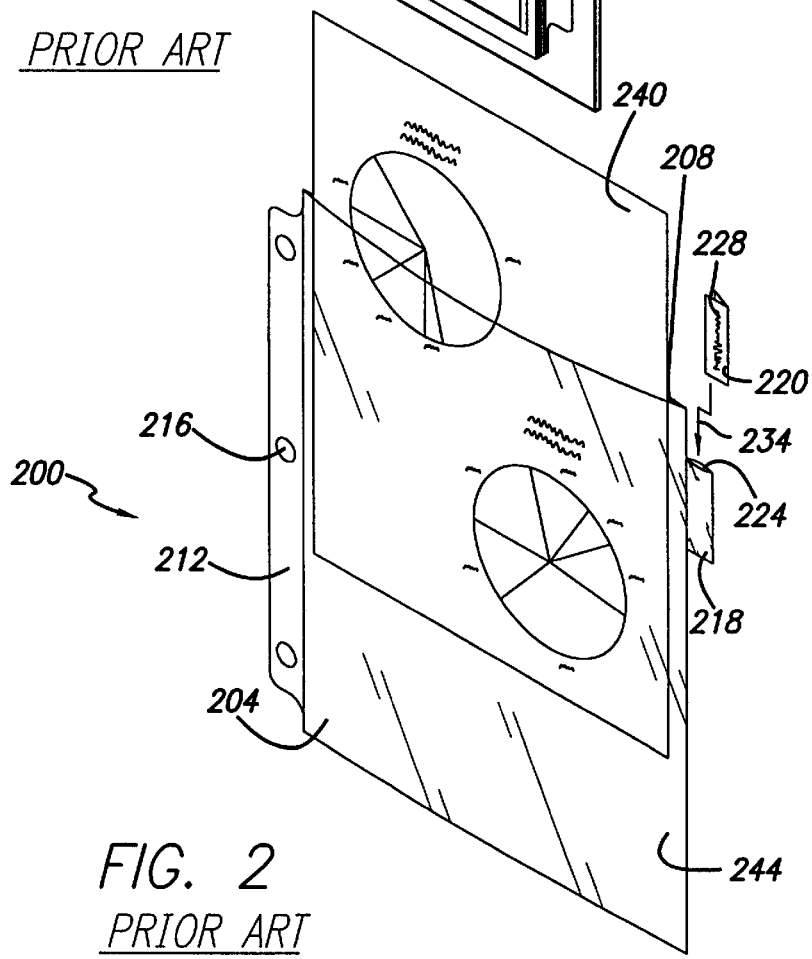
FIG. 2 PRIOR ART
FIG. 2 is a perspective view of a partially-exploded tabbed sheet protector assembly of the prior art.

By having the tab 754 attached to the pocket apparatus 750, the pocket apparatus is not only a table of contents but also serves as a tabbed divider and can have a number of other identifying indicia pre-printed thereon. Unlike the prior art tabbed pocket apparatus of FIG. 2, the tabbed pocket apparatus of FIG. 20 has the descriptive fields 784 pre-printed thereon and has a custom formatted title sheet 790 with printed titles 792 inserted thereon. Also, it preferably has the tab indicia pre-printed 794 thereon.

Figure 21:
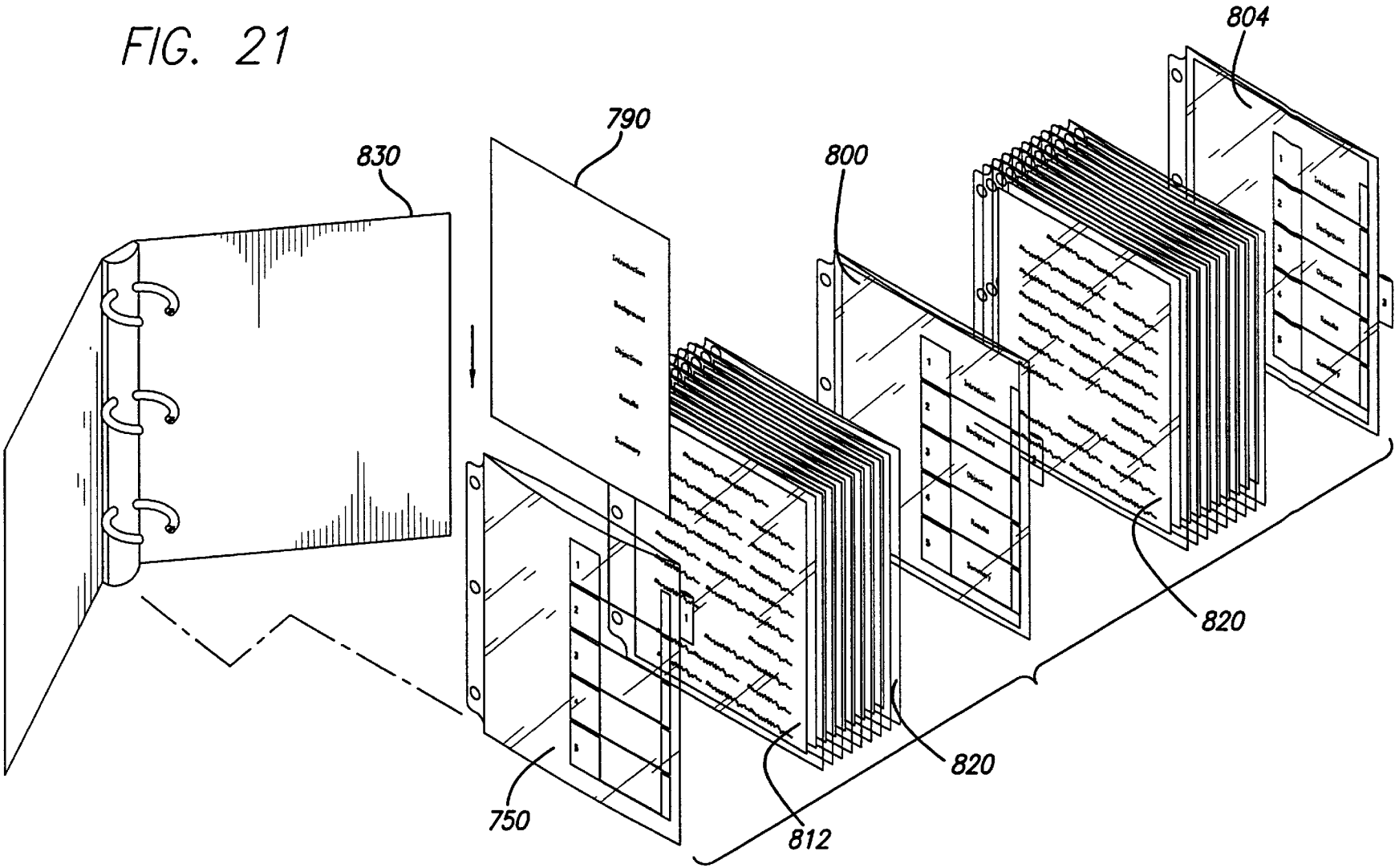
FIG. 21 is a perspective exploded view of an alternative tabbed divider system of the present invention wherein the assembly of FIG. 20 is assembled with similar assemblies having differently placed tabs and with non-tabbed sheet protectors into a ringed binder (or other binding system)

Referring to the system shown generally at in FIG. 21, the tabbed pocket apparatus 750 is assembled with similar tabbed pocket, apparatus 800, 804 having different indicia and positioned tabs, and with document sheets 812 positioned between the tabbed pocket apparatuses. The title sheets 790 for each of the tabbed pocket apparatuses can be identical. The document sheets 812 can also be positioned in (untabbed) transparent pocket dividers 820, as illustrated. A single sheet or multiple sheets can be positioned in each transparent pocket divider 820. And the tabbed pocket apparatuses (with title sheets) and the transparent pocket dividers (with inserted sheets) can be assembled in a ring binder 830 or other binding system.

Figure 22:
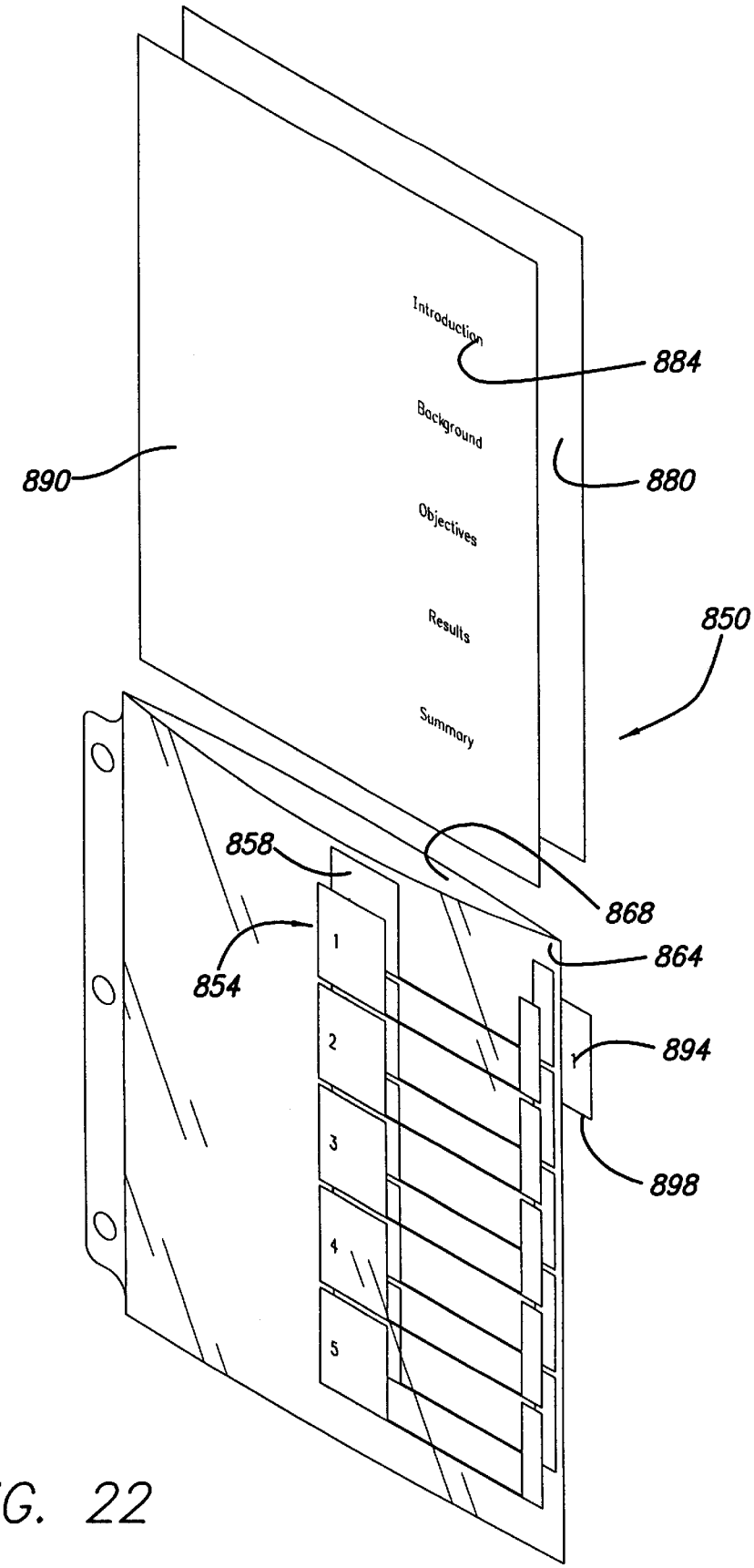
FIG. 22 is a perspective view illustrating similar front and back printed sheets (such as those of FIG. 3) being inserted (back-to-back) into a tabbed transparent sheet protector pocket having pre-printed front and back sides and with indicia (numbers) pre-printed on front and back sides of the integral tabs of the pocket.

Another tabbed pocket apparatus is illustrated in FIG. 22 at 850. It is similar to that of FIG. 20, except that descriptive fields 854, 858 are printed on the transparent front and back sheets 864, 868, and a rear title sheet 880 preferably having the same title 884 printed thereon is inserted rearwardly facing into the pocket behind the front title sheet 890. Indicia 894 is preferably printed on the back side of the tab 898 as well as the front. Thereby, with the binding system open and the back of the tabbed pocket apparatus being exposed the user can identify the number and title of the tabbed section on the left side of the notebook (or other binding system). Instead of having two back-to-back title sheets, a single title sheet printed on both sides can be used. This tabbed pocket apparatus can be used in a system similar to that of FIG. 21.

Figure 23:
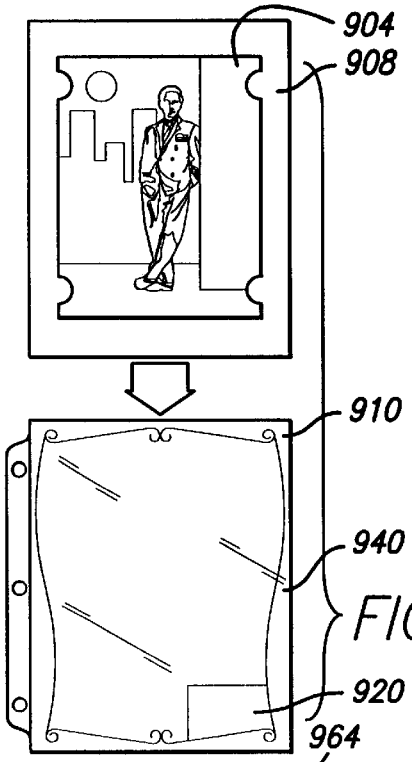
FIG. 23 is a front elevational view showing a photograph (tab-mounted to a backing sheet) being inserted into an alternative pre-printed transparent sheet protector pocket of the present invention.

Most of the previously-described pocket apparatuses are primarily designed to hold a title sheet. However, other documents, pages, papers, clippings or flat articles 904 can be stored and displayed therein. One example is to use them to store and display photographs (or other flat images), such as in the embodiments of FIGS. 23–26. Where the photographs are smaller than the pocket, the photographs can be held on a tabbed sheet 908, such as is illustrated at the top of FIG. 23. The tabbed sheet 908 holds the photograph 904 in place in the pocket apparatus 910 so it does not slide around from side to side or become crooked. It also provides an attractive border for the photograph and protects the edges of the photograph from damage. The tabbed sheet 908 can be similar to that provided in the prior art FRAMED VIEW BINDER available from Avery Dennison Corporation.

In other words, the present inventions improve upon the prior art sheet protector photopages which have welded sections to hold photos of popular sizes. The utility of the prior art product is increased by providing a writeable section 920 on the protector 910 on which the user can date or journal 934 (FIG. 24) adjacent the photograph 904. The attractiveness and utility is increased by providing decorative borders or accent designs 940 to the photographs. The consumer's ability to collage the photopage is increased according to one aspect of the invention by providing several sections for photographs and attractive themed designs to enhace the contents of the photographs.

The pocket assemblies of FIGS. 23–26 each have pre-printed design, indicia or image 940 on their front (and/or back) sheet. This preferably takes the form of a decorative border. And the border can be configured with a theme which corresponds to or compliments the material to be placed in the pocket. A good example of this is the embodiment depicted in FIG. 26 which has a wedding theme wherein the inserted photograph is a wedding photograph and the pre-printed frame has a wedding theme with bells, a bible and flowers. The pre-printed matter instead of a frame can be decorative elements or trademarked designs or images or generally anything. However, it should preferably not completely obscure the underlying stored sheet and in fact should complement it.

Figure 24:
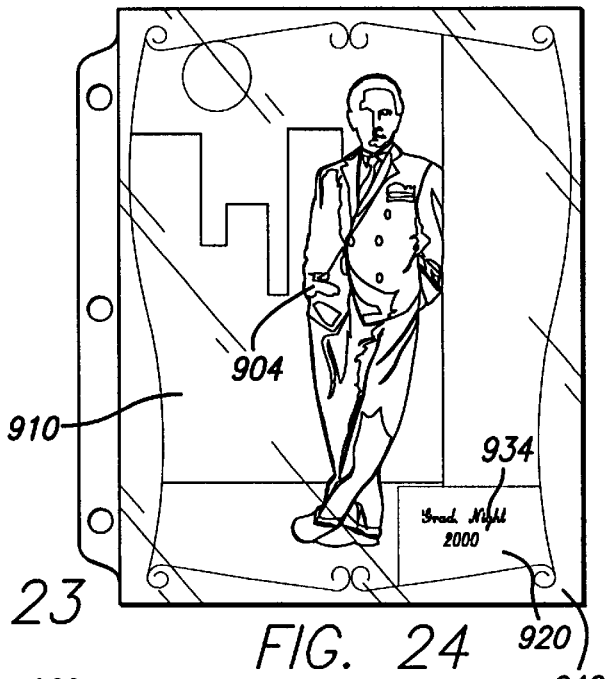
FIG. 24 is an enlarged front elevational view of the assembled apparatus of FIG. 23 with user-custom writing on a lower right writing panel thereof.
Figure 25:
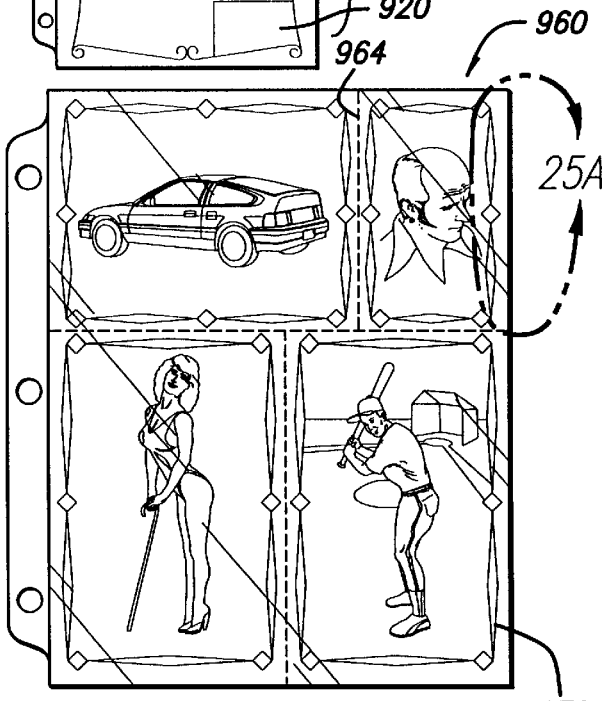
FIG. 25 is a front elevational view showing four photographs inserted in another alternative pre-printed transparent sheet protector pocket of the present invention.
Figure 26:
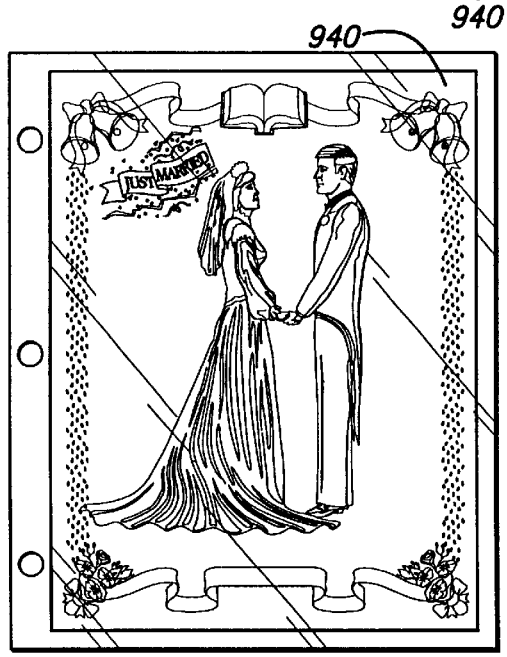
FIG. 26 is a front elevational view illustrating a photograph inserted in yet another alternative pre-printed transparent sheet protector pocket of the present invention.
Figure 25A:
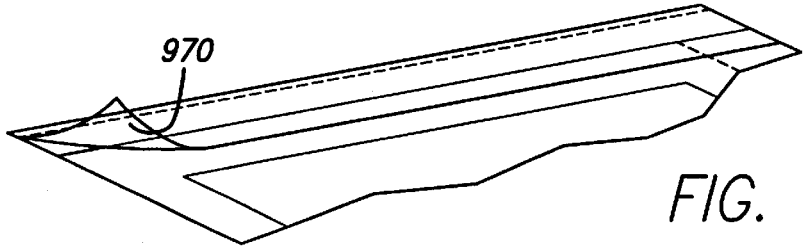
FIG. 25A is an enlarged perspective view taken on circle 25A of FIG. 25 showing a pocket flap.
Figure 27A:
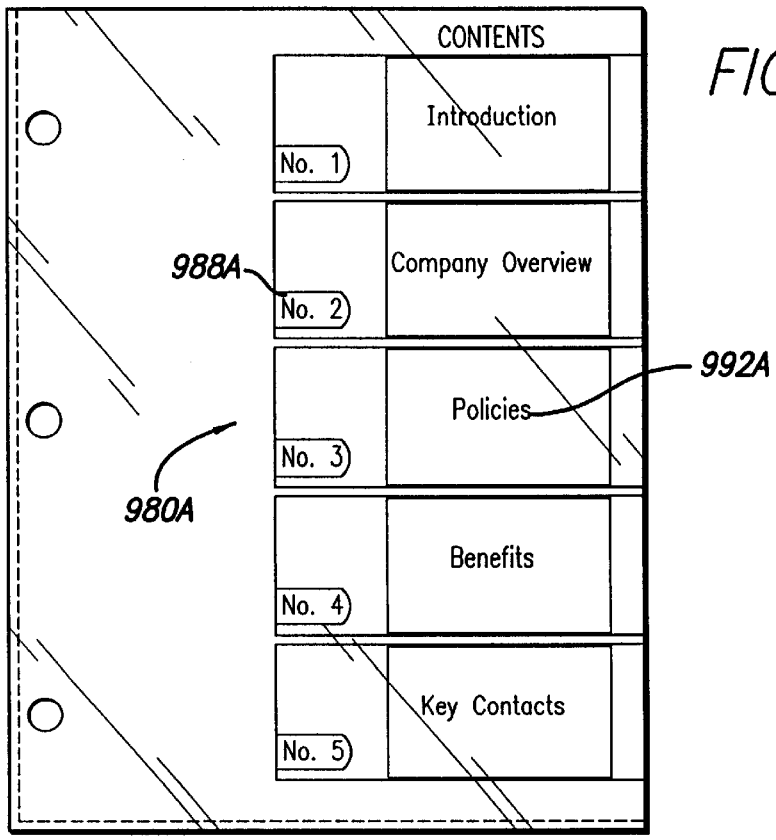
FIGS. 27A, 27B, 27C and 27D show different designs for the front sheet of the pocket protectors with the printed titles of inserted title sheets visible in the field blocks thereof.
Figure 27B:
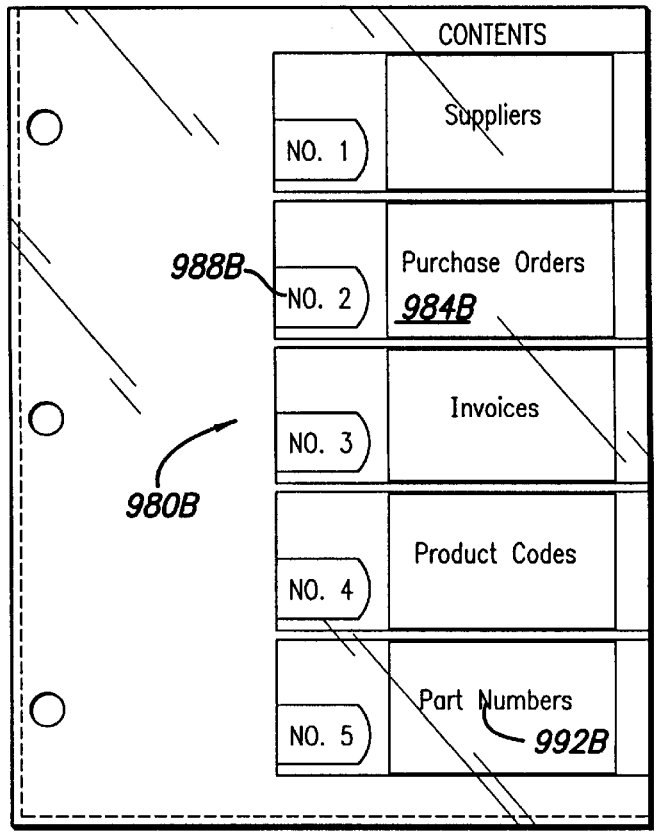
Figure 27C:
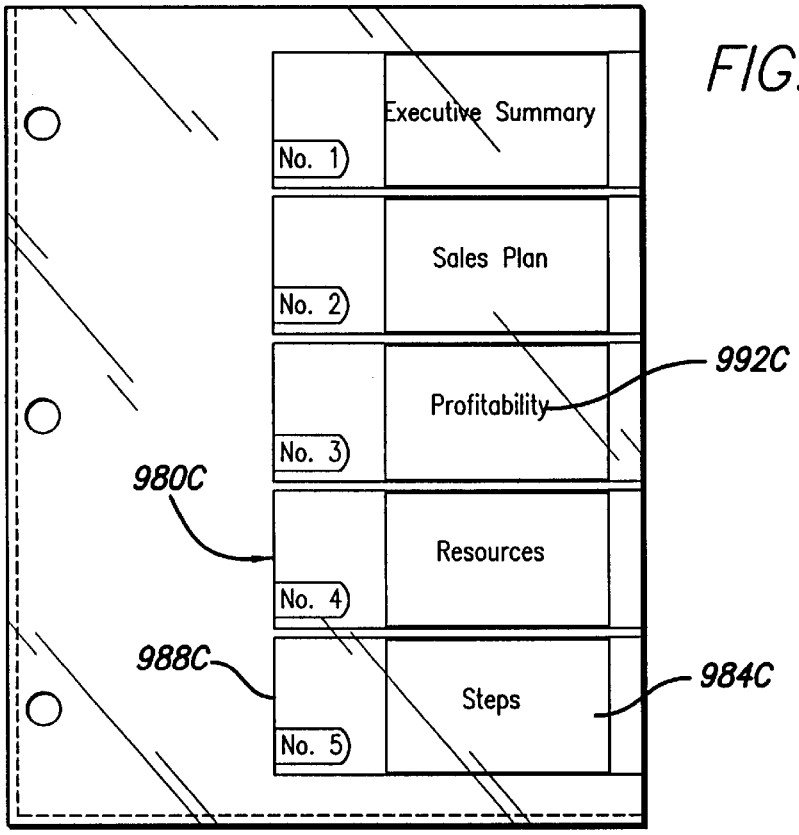
Figure 27D:
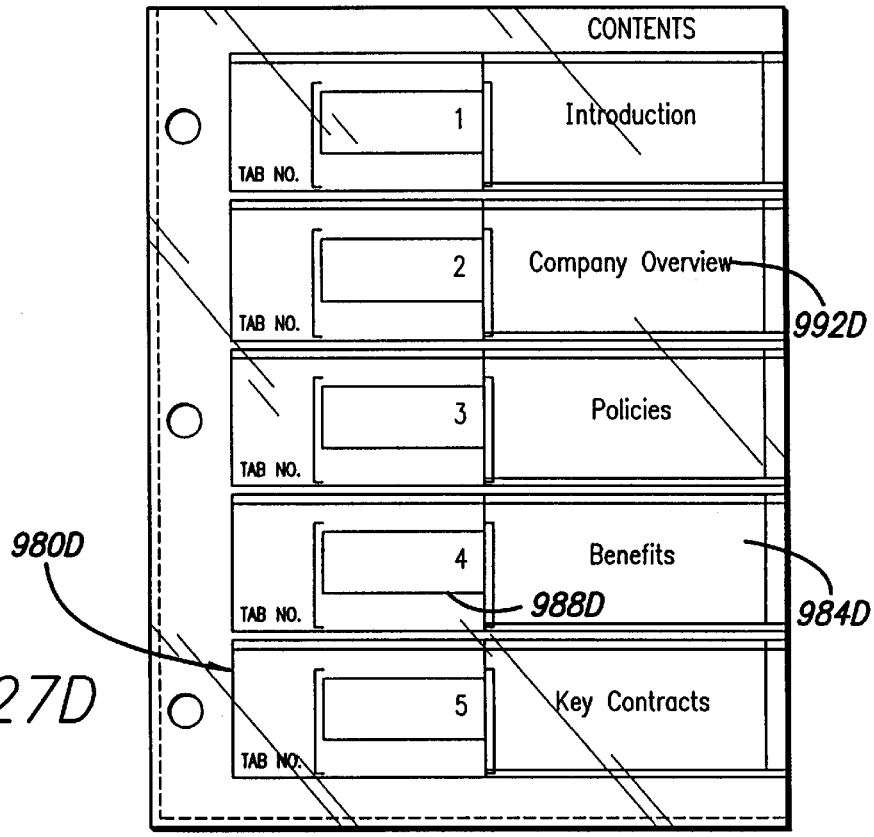

The pocket apparatus can include a surface adapted to be handwritten on by a user with a pen or pencil; such surface is shown in the bottom right corner of FIG. 24 at 920. A further variation of the present invention is to provide a number of pockets each to hold a separate photograph (or other flat object), such as depicted in FIG. 25 by apparatus 960. Each pocket can be separated from the others by welded seams 964. And each pocket will have an opening for inserting the photograph. The opening can be closed with a flap 970, such as shown in FIG. 25A, and having a configuration known in the prior art. Each of the pockets can have its own pre-printing on the front sheet; and the pre-printing can be frame designs 972 as depicted in FIG. 25.

FIGS. 27A–D show alternative designs of the (e.g., rectangular) pocket apparatus, as compared with those of FIGS. 5, 8, 13, 20 and 22. They can have binder holes (as shown) and/or index tabs and/or windows and/or front and back designs as discussed above. Referring to FIGS. 27A–D, the designs include a series of pre-printed fields, each preferably abutting the right edge and preferably aligned with a separate tab when in a binding system with tabbed dividers, and preferably having different colors or shading as described previously. Five fields 980A, 980B, 980C, 980D are shown but different numbers of fields can be provided as desired. Each of the fields has an unprinted area 984A, 984B, 984C, 984D surrounded by a printed area 988A, 988B, 988C, 988D. The titles 992A, 992B, 992C, 992D (or other indicia) on the inserted sheet are clearly visible through the respective unprinted areas.

A usable polypropylene for the pocket apparatuses disclosed herein is a cast polypropylene having a COF of 0.25–0.29. The low COF can be accomplished by adding a slip agent to the formulation of the film, in a known manner. The polypropylene is corona treated to forty to forty-four dyne level; this is a customary step for printing film, the corona treatment charges the film to change the electrostatic properties of the film and makes it more ink receptive. The film is then passed through the print stations and is printed flexographically using UV inks applied with a photopolymer plate. Most narrow web printing operations use several (four to eight) print stations. The print stations can be used to print PMS colors; in other words, the exact color of ink that is desired is loaded into the station and printed. Another option for printing is Process printing—to load four or more colors of ink—black, cyan, magenta and yellow into the print stations to create any color that is desired by laying down layers of these four colors. Process printing is done for products that require more colors than there are stations on the printing press. For a preferred product, up to sixteen colors are printed on the sheet protector. The process is a process printing using six base colors of ink—black, orange, green, cyan, yellow and magenta. This is called hexachrome printing, and it is normally done on offset printing presses, not on flexographic printers. An example of a printer of the invention uses UV hexachrome inks on the flexographic press.

The first print station prints the eye-marks. There is a photo-eye at each following station which registers the eye-mark and prints the next color with reference to the position of the eye-mark. The tolerance is normally held +/−0.005". The last print station applies a clear varnish to the entire surface of the film. It is an antistatic, slip varnish, which is also UV cured. It is applied in thickness from one mil to twenty mils. There are different varnishes available depending on the desired level of COF for the final product. Slip varnish is normally used for printing clear labels for in-mold labels, used on shampoo bottles and other such products. The reason the slip is used is because the labels are stacked in stacks of fifty, and a star wheel pulls off one label at a time for use in putting on the bottle. If there is no slip agent or antistatic varnish, the labels will generate static from the friction of the star wheel and stick to each other. The printed film is wound on a roll and shipped.

The writable coating 920 can be UV ink-white opaque ink printed in the same manner, with two layers used for higher levels of opacity. This coating is similar to that currently used for oil changing "reminder" stickers.

An alternative to the above-described process for printing the decorative and informational indicia, designs or images on the (polypropylene) pockets and sheets is an ink jet printing technique. Pursuant to this technique, the polypropylene is coated with an ink jet receptive coating after extrusion or it is surface treated (embossed) during the extrusion process to accept ink. The web or large sheet of polypropylene is run through a large format ink jet printer. The ink jet printer creates the image by dripping very small droplets of ink such that a the desired image pattern is thereby created. An example of an inherently inkjet printable coextrudable film embodiment and various office product applications of the film are disclosed in copending application entitled "Inherently Ink Receptive Film Substrates," Ser. No. 547,942, filed Apr. 11, 2000.

Screen printing is another method which can be used. Pursuant to this method, the desired image is separated into base colors (i.e., black, magenta, yellow, cyan). Each of the color separations is separately printed. The image of each color is burned into a screen by placing the negative of the color image over a light sensitive screen and exposing it to light, whereby the light expands through pores in the screen. This process can also be done using chemicals instead of light. The screen is then placed on top of the polypropylene or other media that is to be imaged, and ink is spread evenly over the top of the screen. The ink flows through the pores and adheres to the surface of the polypropylene in the desired locations. The process is repeated for each of the base colors until the desired image is achieved. The (polypropylene) media will likely need to be first treated to better accept the ink. This treatment can be done by corona treating it or by coating it with a varnish that acts as a "primer."

Generally, any of the assemblies described herein can be manufactured from polypropylene, vinyl, polyester, polystyrene or any other clear or translucent film that can be formed into a sheet protector. The welding and/or folding of the films can be accomplished by means of heat, ultrasonic, pressure or deformation. Further to the disclosures provided above, examples of possible geometries of the sheet protector are:

(1) A pre-printed 8½ by eleven inch sheet protector, welded at the binding edge and bottom, folded on the right edge and open at the top. The consumer desktop prints his tab titles on a plain sheet of paper, and may or may not hole punch the sheet to line up with the holes in the sheet protector. When the sheet is inserted into the sheet protector, the titles line up with the colored areas of the sheet protector.

(2) A pre-printed 8½ by eleven inch sheet protector, welded at the bottom only, folded along the right edge and open at the binding edge with a three hold punch, in a "quick-load" configuration. The page to be inserted is three hole punched and inserted by peeling back the flap and sliding in the sheet. Once the page is inserted, the assembly can be assembled in a three ring binder or report cover.

(3) A pre-printed 8½ by eleven inch sheet protector that is not welded, but is a folded piece of pre-printed clear film. The fold is along the right side, and the two loose ends are three hole punched. The inserted page is three hole punched and slid between the layers of film, then inserted into a binder or report cover.

(4) A pre-printed paper sleeve with a window, which may or may not have a clear plastic covering. The consumer desktop prints his tab titles on a plain sheet of paper, hole punches the sheets and inserts the printed sheet into the sleeve. The desktop printed tab titles are visible through the window.

(5) A pre-printed 8½ by eleven inch sheet protector (or paper sleeve) with one-half inch sealed binding edge, so that the sleeve is eight inches wide. The software template is changed slightly so that a dashed line is printed out with the tab titles one-half inch from the left edge of the sheet. The consumer can cut along the line or fold the sheet along the line so that the resulting sheet is eight inches wide and can be inserted into the eight inch wide sleeve of the sheet protector. Once inserted, the tab titles line up with the colored areas of the sleeve.

(6) Pre-printed 8½ by eleven inch sheet protector (or paper sleeve) with ½ inch sealed binding edge, so that the sleeve is eight inches wide. A sheet of paper is provided that is perforated ½ inch from the edge along the eleven inch edge of the sheet. After the consumer has printed the perforated sheet, he can removed the perforated edge so that the resulting sheet is eight inches wide and can be inserted into the eight inch wide sleeve of the sheet protector. Once inserted, the tab titles line up with the colored areas of the sleeve.

(7) Pre-printed nine by eleven inch sheet protection, with ½ inch welded binding edge. The consumer desktop prints his tab titles on a plain sheet of paper, then inserts the sheet into the sheet protector. Once inserted, the tab titles line up with the colored areas of the sleeve. Since the clear view table of contents is now nine by eleven inches, the dividers should be extra wide, 9½ by eleven inches.

(8) The invention is a single layer of film or thicker plastic.

From the foregoing detailed description, it will be evident that there are a number of changes, adaptations and modifications of the present invention which come within the province of those skilled in the art. However, it is intended that all such variations not departing from the spirit of the invention be considered as within the scope thereof. A Table showing various alternative constructions of the present inventions follows.

TABLE

| | decorative sheet protector | Clear View TOC | Paper view TOC | photo-frame sheet protector | Ink Jet printable sheet protector | Ink Jet printable insert sheet protector | printed insert sheet protector | clear poly dividers | Printed Lamination Pouch | Printed lamination overlay |
|---|---|---|---|---|---|---|---|---|---|---|
| Materials | | | | | | | | | | |
| polypropylene | x | x | | x | x | x | x | | x | x |
| vinyl | x | x | | x | x | x | x | | x | x |
| polyester | x | x | | x | x | x | x | | x | x |
| polystyrene | x | x | | x | x | x | x | | x | x |
| clear or translucent film | x | x | | x | x | x | x | x | x | x |
| rigid clear or translucent plastic | | | | | | | | x | | |
| paper and film combination | x | | x | x | x | | | | | |
| Paper only | | | x | | | | | | | |
| Method of printing | | | | | | | | | | |
| Prepainted rolls | x | x | | x | | | x | | x | x |
| UV | x | x | x | x | | | x | x | x | x |
| Flexographic | x | x | x | x | | | x | x | x | x |
| Offset | x | x | x | x | | | x | | x | x |
| Process | x | x | x | x | | | x | x | x | x |
| Ink Jet | x | x | x | x | | | x | x | x | x |
| Preprinted Sheets of Poly Film | x | x | x | x | | | x | x | x | x |
| UV | x | x | x | x | | | x | x | x | x |
| Flexographic | x | x | x | x | | | x | x | x | x |
| Offset | x | x | x | x | | | x | x | x | x |
| Process | x | x | x | x | | | x | x | x | x |
| Screen Printing | x | x | x | x | | | x | x | x | x |
| Ink Jet | x | x | x | x | | | x | x | x | x |
| Ink Jet coated film | | | | | x | x | x | x | x | x |
| Print on line | x | x | | x | | | x | x | x | x |
| foil stamp | x | x | x | x | | | | x | | |
| UV | x | x | x | x | | | | | | |
| Flexographic | x | x | x | x | | | | x | | |
| Offset | x | x | x | x | | | | x | x | x |
| Process | x | x | x | x | | | | x | x | x |
| Ink Jet | x | x | x | x | | | x | x | x | x |
| Print finished sheet protectors | x | x | x | x | | | x | x | x | x |
| foil stamp | x | x | x | x | | | x | x | x | x |
| UV | x | x | x | x | | | x | x | x | x |
| Flexographic | x | x | x | x | | | x | x | x | x |
| Offset | x | x | x | x | | | x | x | x | x |
| Ink Jet | x | x | x | x | | | x | x | x | x |
| Screen Print | x | x | x | x | | | x | x | x | x |
| Process | x | x | x | x | | | x | x | x | x |
| Geometries of sheet protectors | x | x | x | x | x | x | x | | x | |
| 7 1/2 × 11 pocket, no binding edge | x | x | x | x | x | x | x | | x | |
| 8 × 11 overall, 8 1/2 × 11 pocket, with binding edge | x | x | x | x | x | x | x | | x | |
| 7 1/2 × 11 overall, 8" pocket with binding edge | x | x | x | x | x | x | x | | x | |
| Welded on bottom and left side, open on top | x | x | x | x | x | x | x | | x | |
| Welded on bottom only, folded on right, open on left and top | x | x | x | x | x | x | x | | x | |
| no welds, folded on right side only | x | x | x | x | x | x | x | | x | |
| welded on left, right and bottom, open on top | x | x | x | x | x | x | x | | x | |
| Welded on top & bottom, folded on right, open on left side | x | x | x | x | x | x | x | | x | |
| Welded on top & bottom, folded on left, open on right | x | x | x | x | x | x | x | | x | |
| Welded on top, bottom, right, open on left | x | x | x | x | x | x | x | | x | |
| Welded on top, bottom, left, open on right | x | x | x | x | x | x | x | | x | |
| single sheet of film | x | x | | x | x | x | x | x | x | x |
| single sheet of film with PSA on back side | x | x | | x | x | x | x | x | x | x |
| folded paper with cut out window | | | x | x | x | x | | | | |
| Folded paper with cut out window, window is covered by a layer of clear film | | | x | x | x | x | | | | |

What is claimed is:

1. An index divider system, comprising:

a package;

a set of dividers having staggered tabs, the dividers being disposed in the package and removable therefrom, said set including at least a first divider having a first tab and a second divider having a second tab;

a sheet protector pocket disposed in the package and removable therefrom;

the pocket having a front sheet and a back sheet;

the pocket having an opening adapted to receive therein between the front and back sheets, with the pocket removed from the package, and into a viewing position a single sheet having a plurality of sheet indicia printed thereon, each indicia on said single sheet aligned with a respective one of the tabs when the single sheet is assembled with the set of index dividers, with the dividers removed from the package, such that a first indicium on said single sheet aligns with the first tab of the first divider, and a second indicium on said single sheet aligns with the second tab of the second divider;

the front sheet allowing the sheet indicia to be viewed therethrough with the sheet in the viewing position; and the front sheet having printed indicia thereon associated with and generally in alignment with the sheet indicia with the sheet in the viewing position.

2. The system of claim 1 wherein:

said single sheet further has a third indicium printed thereon;

said set of dividers further includes a third divider having a third tab;

said first divider is disposed over said second divider, and said second divider is disposed over said third divider; and said first, second, and third indicia on said single sheet aligns with said first tab on said first divider, said second tab on said second divider, and said third tab on said third divider, respectively.

3. The system of claim 1 wherein said indicia on said single sheet in conjunction with said indicia on said front sheet cooperating to define a color coded table of contents assisting a user to quickly locate a desired one of said dividers when said dividers are assembled with said front sheet and said single sheet.

4. The system of claim 1 further comprising an instruction sheet disposed in the package and removable therefrom by a user.

5. The system of claim 1 wherein the sheet is disposed in the package and removable therefrom for application of the sheet indicia thereon and insertion in the pocket.

6. The system of claim 1 wherein:

said first indicium on said single sheet aligns generally horizontally with said first tab divider when assembled such that a user is directed to the first tab by said first indicium; and said second indicium on said single sheet aligns generally horizontally with said second tab divider when assembled such that a user is directed to the second tab by said second indicium.

7. The system of claim 6 wherein:

said front sheet indicia includes at least a first front sheet indicium of a first color and a second front sheet indicium of a second color;

said first color corresponds to a color on said first tab; and said second color corresponds to a color on said second tab;

such that the indicia on said single sheet and the indicia on said front sheet cooperate to provide to the user color-coded indicia which employs colors to help direct a user to desired ones of said dividers and which provides to the user information regarding content which may be found at respective horizontally aligned ones of said dividers.

8. The system of claim 1 wherein:

said front sheet indicia includes at least a first front sheet indicium of a first color and a second front sheet indicium of a second color;

said first color corresponds to a color on said first tab; and said second color corresponds to a color on said second tab.

9. The system of claim 1 wherein said first indicium on said single sheet directs a user to said first tab, and said second indicium on said single sheet directs a user to said second tab.

10. The system of claim 1 wherein:

a first indicium on said front sheet aligns generally horizontally with said first indicium on said single sheet, and further aligns generally horizontally with said first tab on said first divider to direct a user to said first divider; and a second indicium on said front sheet aligns generally horizontally with said second indicium on said single sheet, and further aligns generally horizontally with said second tab on said second divider to direct the user to said second divider.

11. An index divider system, comprising:

a set of dividers having staggered tabs;

a first sheet having a plurality of first sheet indicia thereon;

a second sheet having a plurality of second sheet indicia thereon;

the first sheet being adhered to a back of the second sheet to form a sheet assembly with the first sheet indicia being visible through the second sheet; and such that with the sheet assembly assembled, a first indicium on said first sheet aligns with a first tab of a first divider, and a second indicium on said first sheet aligns with a second tab of a second divider, each indicium thereby directing a user to a desired one of said tabs.

12. The system of claim 11 wherein the first and second sheets are adhered together with adhesive.

13. The system of claim 11 wherein the first and second sheets are adhered together with thermally activated adhesive.

14. The system of claim 11 wherein the first sheet indicia comprises user-printed indicia.

15. The system of claim 11 wherein the second sheet indicia comprises manufacturer pre-printed indicia.

16. The system of claim 11 wherein the sheet assembly includes binder holes and the dividers include binder holes.

17. The system of claim 11 wherein:

said first and second sheet indicia cooperate together and further cooperate with said respective ones of said tabs to direct a user thereto.

18. The system of claim 17 wherein:

said tabs include at least a first tab of a first color and a second tab of a second and different color;

said first and second sheet indicia include at least:

a first colored indicium, said first colored indicium corresponding in color to said first colored tab; and a second colored indicium, said second colored indicium corresponding in color to said second colored tab;

such that the first and second sheet indicia taken together with the first and second tabs provide to the user color-coded indicia which employs colors to help direct a user to a desired one of said dividers and which provides to the user information regarding content which may be found at said dividers.

19. An index divider system, comprising:

a set of dividers having staggered tabs, said set including at least a first divider having a first tab and a second divider having a second tab;

a first sheet having a plurality of first sheet indicia thereon, said first sheet indicia including at least a first sheet first indicium and a first sheet second indicium;

a second sheet having a plurality of second sheet indicia thereon, said second sheet indicia including at least a second sheet first indicium and a second sheet second indicium;

the first sheet being bound with the second sheet to form a sheet assembly with the first sheet indicia being visible through the second sheet;

with the sheet assembly stacked on and bound with the dividers the first and second sheet indicia being aligned with respective ones of the tabs, such that the first sheet first indicium is aligned with the second sheet first indicium and is further aligned with the first tab of said first divider, and such that the first sheet second indicium is aligned with the second sheet second indicium and is further aligned with the second tab of the second divider; and a tabless sheet positioned between adjacent ones of said dividers.

20. The system of claim 19 wherein the first sheet is bound with the second sheet using a binding system selected from the group of tape binding, thermal binding, comb binding, velo binding and staple binding.

21. The system of claim 19 wherein:

said first sheet first indicium, said second sheet first indicium, and said first tab are aligned so as to visually group together said first sheet first indicium, said second sheet first indicium, and said first tab; and aid first sheet second indicium, said second sheet second indicium, and said second tab are aligned so as to visually group together said first sheet second indicium, said second sheet second indicium, and said second tab.

22. An organization system, comprising:

a first sheet holding and viewing apparatus including: a first sheet protector pocket having a first front sheet, a first back sheet, an outwardly extending first tab and a first opening, the first pocket being adapted to receive therein and into a viewing position through the opening a first sheet having a plurality of sheet indicia thereon, the first front sheet allowing the sheet indicia to be viewed therethrough with the first sheet disposed in the first pocket, and the first front sheet having front sheet indicia thereon associated with and generally in alignment with the sheet indicia with the first sheet in the viewing position, and with the first sheet in the viewing position at least one of the sheet indicia and one of the first front sheet indicia being aligned with the first tab;

a second sheet holding and viewing apparatus including: a second sheet protector pocket having a second front sheet, a second back sheet, an outwardly extending second tab and a second opening, the second pocket being adapted to receive therein and into a viewing position through the second opening a second sheet having a plurality of sheet indicia thereon, the second front sheet allowing the sheet indicia to be viewed therethrough with the second sheet disposed in the second pocket, and the second front sheet having front sheet indicia thereon associated with and generally in alignment with the sheet indicia with the second sheet in the viewing position, with the second sheet in the viewing position at least one of the sheet indicia and one of the second front sheet indicia being aligned with the second tab, the second tab being staggered with respect to the first tab;

a tabless third sheet holding and viewing apparatus disposed between the first and second apparatuses;

a binding system binding the first, second and third sheet holding and viewing apparatuses together;

wherein:

said indicia on said first sheet and said indicia on said first front sheet align generally horizontally with said first tab to create a visual association therewith at a first vertical position;

said indicia on said second sheet and said indicia on said second front sheet align generally horizontally with said second tab to create a visual association therewith at a second vertical position; and said first vertical position is vertically offset from said second vertical position.

23. The system of claim 22 wherein the binding system includes a three ring binder notebook.

24. The system of claim 22 wherein the first, second and third sheet holding and viewing apparatuses each have binder holes.

25. The system of claim 22 wherein the third sheet holding and viewing apparatus has a third pocket for receiving therein into a viewing position a third sheet.

26. A method of organizing tab dividers, comprising:

providing a set of tab dividers having staggered tabs, said set including at least first and second tab dividers;

providing a sheet protector having protector indicia thereon, each associated with a different one of the tab dividers and positioned to be aligned with a respective one of the tabs such that a first protector indicium on said protector aligns with a first tab divider and a second protector indicium on said protector aligns with a second tab divider when the protector is aligned with the tab dividers, the sheet protector having a compartment and a front sheet;

providing a sheet having sheet indicia each associated with a different one of the tab dividers, said sheet indicia including at least first sheet indicium and second sheet indicium on said sheet; and inserting the sheet into the compartment into a viewing position such that the first sheet indicium and second sheet indicium are viewable through the front sheet and the first sheet indicium and second sheet indicium, respectively, and are aligned with the first tab divider the said second tab divider, respectively.

27. The method of claim 26 wherein the second indicia are designed by a user using software and are applied on the sheet.

28. The method of claim 27 wherein the second indicia is applied using a printer, a copier, a typewriter, an applied label or handwriting.

29. The method of claim 27 wherein the second indicia are associated with respective ones of the first indicia and in substantial alignment therewith when the sheet is in the viewing position.

30. The method of claim 26 wherein the tab dividers and the sheet protector include binder holes, and further comprising inserting the tab dividers and the sheet protector into a ring binder.

31. The method of claim 26 wherein the sheet protector and the sheet includes binder holes which are aligned when the sheet is in the viewing position.

32. The method of claim 31 further comprising before the inserting, punching the binder holes in the sheet.

33. The method of claim 26 further comprising before the inserting, removing the sheet protector and the dividers from retail packaging.

34. The method of claim 26 wherein the sheet defines a first sheet, and further comprising providing a second sheet having third indicia, which is different from the second indicia, each of the third indicia associated with a different one of the tab dividers, and after the inserting, inserting the second sheet into the compartment into a viewing position such that the third indicia is viewable through the front sheet and the third indicia are each alignable with a respective one of the tabs with the sheet protector in position relative to the set of tab dividers.

35. The method of claim 34 further comprising after the inserting, removing the first sheet from the compartment and inserting a substitute sheet having different indicia thereon.

36. The method of claim 26 further comprising providing insert sheets, and binding the tab dividers, insert sheets and sheet protector together.

37. The method of claim 36 wherein the binding includes ring notebook binding, thermal binding, or comb binding.

38. The method of claim 26 further comprising:

aligning said indicia with said tab dividers such that:

each individual sheet indicium is uniquely visually associated with an individual cover indicium; and each individual cover indicium is uniquely visually associated with an individual tab divider.

39. The method of claim 38 wherein said aligning step comprises generally horizontally aligning.

40. The method of claim 38 further comprising:

coloring said first cover indicium and said first tab a first color; and coloring said second cover indicium and said second tab a second color, said second color being different from said first color, thereby enhancing said visual associations.

41. A method of organizing tab dividers, comprising:

providing a set of tab dividers having staggered tabs;

providing a sheet protector, the sheet protector having a compartment and a front sheet;

providing a first sheet having first sheet indicia, each associated with a respective one of the tab dividers;

providing a second sheet having second sheet indicia, each associated with a respective one of the tab dividers; and inserting the first and second sheets into the compartment into a viewing position with the second sheet in front of the first sheet such that the second indicia are viewable through the front sheet and the first indicia are viewable through the second sheet and front sheet.

42. The method of claim 41 further comprising inserting the tab dividers and the sheet protector in a ring binder.

43. The method of claim 41 wherein the front sheet comprises a transparent sheet.

44. The method of claim 41 wherein the front sheet has at least one viewing window for the first and second indicia.

45. The method of claim 41 wherein the second sheet comprises a transparent sheet.

46. The method of claim 41 wherein the first sheet providing includes designing the first sheet indicia on a computer and passing a sheet through a printer or copier so that the first sheet indicia is printed thereon.

47. The method of claim 46 wherein the second sheet providing includes designing the second sheet indicia on a computer and passing a sheet through a printer or copier so that the second sheet indicia is printed thereon.

48. The method of claim 41 further wherein:

individual indicia among said first sheet indicia are disposed in general linear alignment with respective individual indicia among said second sheet indicia, and are further disposed in general linear alignment with respective individual ones of said staggered tabs, so as to create a visual linear association between individual ones of said first and second sheet indicia and individual ones of said staggered tabs.

49. A method of organizing tab dividers, comprising:

providing a first sheet having first sheet indicia;

providing a second sheet having second sheet indicia; and adhering the second sheet to a top surface of the first sheet such that the first sheet indicia can be viewed through the second sheet and the first sheet indicia are aligned with respective ones of the second sheet indicia and both are aligned with staggered respective tabs of the set of tab dividers.

50. The method of claim 49 wherein the first sheet indicia are custom design and printed by a user.

51. The method of claim 49 wherein the second sheet indicia are pre-printed by a manufacturer.

52. The method of claim 49 wherein the second and first sheets are adhered together with adhesive.

53. The method of claim 49 wherein the second sheet is adhered to the first sheet with at least one adhesive strip on a rear side of the second sheet.

54. An index divider system, comprising:

a set of tabbed dividers having staggered tabs;

a sheet pocket protector having a front sheet and a back sheet;

the sheet pocket protector being positionable by a user on top of the set of tabbed dividers and assembled therewith in an assembled position;

the sheet pocket protector being adapted to receive therein, in a viewing position, a sheet having a plurality of sheet indicia printed thereon;

each sheet indicia being aligned with a respective one of the tabs when the sheet pocket protector is in the assembled position and the sheet is in the viewing position;

the front sheet having printed indicia printed thereon, the printed indicia being generally aligned with the sheet indicia with the sheet in the viewing position and the printed indicia being operatively associated with the staggered tabs with the sheet pocket protector in the assembled position; and the front sheet allowing the sheet indicia to be viewed therethrough with the sheet in the viewing position.

55. The index divider system of claim 54 wherein the printed indicia being operatively associated with the staggered tabs comprises the printed indicia having colors according to colors of the staggered tabs.

56. The index divider system of claim 54 wherein the printed indicia being operatively associated with the staggered tabs comprises the printed indicia including symbols according to symbols on the staggered tabs.

57. The index divider system of claim 56 wherein the symbols include alphanumeric characters.

58. The index divider system of claim 54 wherein the printed indicia being operatively associated with the staggered tabs comprises the printed indicia being spatially aligned with the staggered tabs when the sheet pocket protector is in the assembled position.

59. The index divider system of claim 54 wherein the sheet pocket protector is a first sheet pocket protector, the index divider system further comprising:

a second sheet pocket protector; and a set of sheets positioned between the first sheet pocket protector and the second sheet pocket protector.

60. The index divider system of claim 59 wherein the sheet indicia correspond to subject matter of the set of sheets.

61. The system of claim 59 wherein the tabbed dividers and the sheet pocket protector have binder holes which are aligned with one another when the tabbed dividers and the sheet pocket protectors are in a binding system.

62. The system of claim 61 wherein the binding system is a three-ring binder notebook.

63. The system of claim 54 wherein the front sheet has a window through which the sheet indicia is viewable with the sheet disposed in the sheet pocket protector.

64. The system of claim 63 wherein the front sheet comprises an opaque or translucent sheet with the window disposed therein.

65. The system of claim 63 wherein the window comprises a through-opening.

66. The system of claim 63 wherein the window includes a plastic film pane.

67. The system of claim 54 wherein the sheet indicia is user-designed and printed.

68. The system of claim 54 wherein the sheet pocket protector has an open top in through which the sheet is inserted into the viewing position, and closed side and bottom edges.

69. The system of claim 54 wherein the sheet pocket protector has an open top and at least one open side.

70. The system of claim 54 wherein the front and back sheets comprise two separate webs that are welded together.

71. The system of claim 54 wherein the front and back sheets comprise a single web that is folded onto itself.

72. The system of claim 54 wherein the front and back sheets comprise plastic film.

73. The system of claim 54 wherein the front and back sheets comprise paper.

74. The system of claim 54 wherein the sheet indicia are applied using a printer, a copier, a typewriter or by hand.

75. The system of claim 54 wherein the sheet indicia comprise manufacturer pre-printed indicia.

76. The system of claim 54 wherein the tabbed dividers, the sheet and the sheet pocket protector each have binder holes.

77. The system of claim 76 wherein a storage area defined by the sheet pocket protector has slightly larger width and length dimensions than those of the sheet to maintain the sheet therein and the holes of the sheet and the sheet pocket protector are aligned.

78. The system of claim 76 wherein the binder holes pass through both the front and back sheets.

79. The system of claim 76 wherein the sheet pocket protector includes a binder strip sealed to the front and back sheets and through which the binder holes pass.

80. The system of claim 54 wherein the sheet comprises a paper sheet.

81. The system of claim 54 wherein the sheet pocket protector is laminated closed with the sheet disposed therein.

82. The system of claim 54 wherein the sheet pocket protector includes a binder strip with binder holes sealed to and extending out from the front and back sheets.

83. The system of claim 54 wherein the tabbed dividers comprise opaque paper dividers.

84. The system of claim 54 wherein the pocket includes a binder strip having binder holes and extending out from the front and back sheets.

85. The index divider system of claim 54 wherein:

said alignment creates a visual one-to-one mapping from each individual indicium on said front sheet within said pocket to each individual tab, to direct a user's attention to individual tabs, respectively.

86. The index divider system of claim 85 wherein said alignment is linear alignment.

87. The index divider system of claim 86 wherein said alignment is linear horizontal alignment.

88. An index divider system, comprising:

a set of dividers having staggered tabs;

a sheet protector pocket having a front sheet and a back sheet;

the pocket having an opening adapted to receive therein between the front and back sheets, and into a viewing position, a sheet having a plurality of sheet indicia printed thereon, each indicium aligned with a respective one of the tabs to create a visual association therebetween when the sheet is assembled with the set of index dividers;

an at least partially transparent sheet positionable in the pocket so as to be in front of the sheet and in a viewing position;

the front sheet allowing the sheet indicia to be viewed therethrough with the sheet in the viewing position and through the transparent sheet disposed in front of the sheet in the pocket; and with the transparent sheet in the viewing position, the front sheet allowing indicia on the transparent sheet to be viewed therethrough.

89. The system of claim 88 wherein the printed indicia on the transparent sheet is preprinted on the transparent sheet.

90. The system of claim 88 wherein the indicia on the transparent sheet is custom designed and printed thereon by a consumer.

91. The system of claim 88 wherein the front sheet comprises a transparent sheet.

92. The system of claim 88 wherein the front sheet includes a window through which the sheet indicia and the transparent sheet indicia are viewed with the sheet and the transparent sheet in their respective viewing positions.

93. The system of claim 88 further comprising retail packaging in which the dividers, pocket and transparent sheet are disposed and removable therefrom for assembly.

94. The system of claim 88 wherein the sheet indicia are positioned to be aligned with the staggered tabs when the sheet is in the viewing position.

95. The index divider system of claim 88 wherein each indicium aligned with a respective tab is generally horizontally aligned therewith, with each indicium positioned to the left of said respective tab.

96. An index divider system, comprising:

a plurality of divider sheets each having a tab extending therefrom;

a first sheet having a plurality of first sheet indicia printed thereon;

a second sheet having a plurality of second sheet indicia printed thereon;

a sheet protector assembly having a front sheet, a back sheet, a top opening and a compartment defined between the sheets and communicating with the top opening;

with the first and second sheets in the compartment and with the second sheet in front of the first sheet, the second sheet allowing the first sheet indicia to be viewed therethrough and the front sheet allowing the first and second sheet indicia to be viewed therethrough; and wherein with the sheets disposed in the compartment respective ones of the first and second sheet indicia are generally in alignment with respective ones of the tabs to direct a user's attention to said respective tabs.

97. The system of claim 96 wherein the front sheet comprises a transparent sheet.

98. The system of claim 96 wherein the front sheet comprises an opaque or translucent sheet having a window through which the first and second sheet indicia are viewable.

99. The system of claim 96 wherein the assembly has binder holes.

100. The system of claim 99 wherein the first and second sheets have binder holes which are aligned with the binder holes of the assembly when the sheets are in the compartment.

101. The system of claim 96 wherein the second sheet is a transparent sheet.

102. The system of claim 96 wherein the first sheet is a paper sheet.

103. The system of claim 96 further comprising a set of dividers having staggered tabs, the set being positionable with the assembly such that with the first and second sheets in the compartment, the first and second indicia are positioned to be aligned with respective ones of the staggered tabs.

104. The system of claim 103 wherein the dividers have divider binder holes and the assembly has binder holes alignable with the divider binder holes.

105. The system of claim 96 wherein the sheet protector has an index tab extending out therefrom and aligned with at least one indicia of the first sheet indicia and at least one indicium of the second sheet indicia.

106. The system of claim 105 further comprising a tab insert with tab indicia in the index tab.

107. The system of claim 105 further comprising a tab label with tab indicia adhered to the index tab.

108. The index divider system of claim 96 wherein said general alignment is general linear alignment which creates a visual user association between individual indicia on said first and second sheets and individual ones of said tabs, thereby assisting a user to locate a desired one of said tabs when viewing the first and second sheets in the compartment.

* * * * *